US011745383B2

(12) United States Patent
Wilson, IV et al.

(10) Patent No.: US 11,745,383 B2
(45) Date of Patent: Sep. 5, 2023

(54) POTTERY WHEEL WITH THROWING ARM

(71) Applicant: IDEA VAULT HOLDINGS INC, Ashland, OR (US)

(72) Inventors: Howard Allen Wilson, IV, Medford, OR (US); Michael E. Munter, Ashland, OR (US); Joshua J. Gedlick, Ashland, OR (US)

(73) Assignee: IDEA VAULT HOLDINGS INC, Ashland, OR (US)

( * ) Notice: Subject to any disclaimer, the term of this patent is extended or adjusted under 35 U.S.C. 154(b) by 0 days.

(21) Appl. No.: 17/096,315

(22) Filed: Nov. 12, 2020

(65) Prior Publication Data

US 2022/0143864 A1 May 12, 2022

(51) Int. Cl.
*B28B 1/02* (2006.01)

(52) U.S. Cl.
CPC ..... *B28B 1/025* (2013.01)

(58) Field of Classification Search
None
See application file for complete search history.

(56) References Cited

U.S. PATENT DOCUMENTS 2,213,784 A * 9/1940 Landow ..... B28B 1/025 434/82
2,586,628 A 2/1952 Ellis
2,638,653 A * 5/1953 Adams ..... B28B 1/02 425/459
4,057,384 A * 11/1977 Reid ..... B28B 1/025 425/459
8,770,963 B2 7/2014 Kuriki
(Continued)

FOREIGN PATENT DOCUMENTS

DE 3527576 A * 2/1987 ..... B28B 1/02
GB 530144 A * 12/1940

OTHER PUBLICATIONS

Machine English translation of DE-3527576-A, Accessed May 13, 2022 (Year: 1940).*

(Continued)

*Primary Examiner* — Jacob T Minskey
*Assistant Examiner* — Adrianna N Konves
(74) *Attorney, Agent, or Firm* — Lewis Roca Rothgerber Christie LLP

(57) ABSTRACT

A pottery wheel with an improved throwing arm that pushes the clay towards the center of the spinning plate, in an arc shaped motion, defined by four directions of motion, with the throwing arm providing an inward force towards the direction of rotation and towards the axis of rotation, that also allows for micro-adjustments to be easily made, is disclosed. Various tool accessories can then be used to open the pottery and form the pottery. The embodiments of the present invention are suitable for use by children, individuals unskilled in the art of pottery, and individuals lacking fine motor skills due to the assistance provided by the features of present embodiments, including an improved throwing arm removably attached to the housing. Embodiments of the present invention also include numerous attachments designed to work in tandem with the improved pottery wheel and throwing arm assembly.

19 Claims, 33 Drawing Sheets

(56) References Cited

U.S. PATENT DOCUMENTS

| | | | | |
|---|---|---|---|---|
| 2004/0142061 | A1* | 7/2004 | Oakes | B28B 1/025 425/459 |
| 2004/0143921 | A1* | 7/2004 | Borkin | B44D 3/00 401/6 |
| 2005/0025850 | A1* | 2/2005 | D'Estais | B28B 1/025 425/263 |
| 2009/0140460 | A1* | 6/2009 | Fulwood | B28B 1/02 425/112 |

OTHER PUBLICATIONS

International Search Report and Written Opinion for corresponding PCT Application No. PCT/US2021/059084, dated Feb. 3, 2022 (12 sheets).

MindWare Pottery Wheel for Kids and Beginners with Air-Dry Clay Refill, Amazon.com printout retrieved from https://www.amazon.com/MindWare-Pottery-Wheel-Beginners-Refill/dp/B06XX19KZ4/ref=sr_1_6?dchild=1&keywords=kids+pottery+wheel+&qid=1602734288&sr=8-6 (Accessed Apr. 12, 2023) 5 pages.

Dan&Darci Advanced Pottery Wheel Kit, Amazon.com printout retrieved from https://www.amazon.com/Dan-Darci-Advanced-Pottery-Wheel/dp/B0BL52XFPJ?ref =ast_sto_dp (Accessed Apr. 12, 2023) 7 pages.

Faber-Castell Pottery Studio—Kids Pottery Wheel Kit, Amazon.com printout retrieved from https://www.amazon.com/Faber-Castell-Pottery-Studio-Wheel-Kids/dp/B00MTKRTBC/ref=sr_1_5?dchild=1&keywords=kids%2Bpottery%2Bwheel&qid=1602717704&sr=8-5&th=1 (Accessed Apr. 12, 2023) 9 pages.

Made by Me My Very Own Pottery Wheel Kit by Horizon Group USA, Amazon.com printout retrieved from https://www.amazon.com/Made-Pottery-Wheel-Refill-Horizon/dp/B06WP1HXRK/ref=sr_1_22_sspa?dchild=1&keywords=kids%2Bpottery%2Bwheel&qid=1602717704&sr=8-22-spons&spLa=ZW5jcnlwdGVkUXVhbGlmaVVVyPUFBQIIMSzExQjqySOYmZW5icnIwdGVkSWQ9QTAxOTMxNTFOQjcwUORJTzJCUlgmZW5jcnIwdGVkQWRJZD1BMDcwNzcxMzFITjRENkVDUOIFRTcmd2lkZ2V0TmFtZT1zcF9tdGYmYWN0aW9uPWNsaWNrUmVkaXJ1Y3QmZG90b3RMb2dDbGliaz10cnVl&th=1 (Accessed Apr. 12, 2023) 9 pages.

Cool Maker—Pottery Studio, Clay Pottery Wheel Craft Kit by Spin Master, Amazon.com printout retrieved from https://www.amazon.com/Cool-Maker-Pottery-Studio-Wheel/dp/B019K8WM4O?ref=ast_sto_dp (Accessed Apr. 12, 2023) 8 pages.

* cited by examiner

POTTERY WHEEL WITH THROWING ARM

FIELD

The invention relates to machinery for assisting in the production of hand sculpted pottery, and more specifically, to apparatuses for the production of hand sculpted pottery by individuals of varying skill.

BACKGROUND

Pottery and sculptures molded from clay have been produced for many years, both as works of art and as goods of a utilitarian nature. Traditionally, pottery has been sculpted into its desired shape by hand, an activity that takes many hours, and requires great artistic skill in order to produce an aesthetically pleasing final product. In recent years, a variety of tools and apparatuses have been developed to assist in the sculpting of clay pottery, including pottery wheels.

Pottery wheels, generally speaking, are spinning plates attached to a rotary motor which are used to rotate the blocks of clay about an axis to allow for them to be molded into shape by the sculptor holding their hand stationary at a point in contact with the clay block. Tools may also be used to mold the clay as it rotates about an axis and they contact the perimeter of the clay at a particular point. Pottery wheels are especially useful for the production of circular shaped pieces such as pots or vases.

One of the challenges associated with the use of pottery wheels is difficultly in centering the clay precisely in the center, or middle, of the spinning plate. If the block of clay is displaced from the center of the spinning plate in any direction, the clay may rupture or be sculpted into a non-symmetrical shape, producing an aesthetically displeasing final product. It also can result in excess waste, in which clay that ruptures due to being manipulated while off center is disposed of.

In order to address the difficulty in centering blocks of clay precisely in the center of the spinning plate, a number of tools have been used which mitigate the effect on clay due to it being displaced from the center, or to help center the clay. Tower attachments fixed at a position away from the spinning plate have been used to manipulate tools about the spinning plate. However, these attachments may fail to reliably center the clay in middle of the spinning plate, and often cause the clay to rupture.

Molds attached to a fixed location in the center of the spinning plate have also been used to attempt to better center the clay in the middle of the spinning plate. However, they offer only limited flexibility in the artwork that can be produced with them because they come in only a few shapes and sizes, often in the shape of a pot. They also tend to form the clay into a non-appealing shape because tools which are used over the mold often pierce the clay and cut all the way through it.

There remains a need in the art of pottery for a pottery wheel which allows for the accurate and precise centering of clay in the middle of a spinning plate by a user of minimal skill, while not limited the works of art being produced by the wheel. Similarly, there remains a need in the art for tools which can be used to manipulate the clay into an aesthetically pleasing shape on a pottery wheel by a user of minimal skill, which is compatible with and improved pottery wheel and centering apparatus.

SUMMARY

It is appreciated by the inventors that prior art pottery wheels and their attachments fail to provide adequate assistance in the centering and sculpting of clay, especially for children and individuals new to the art of pottery. In particular it is noted by the inventors that tower assemblies which pull the clay outwards from the center of the spinning plate often result in the destruction of the clay as it is easy to damage the clay when pulling outward against the direction of force imparted by rotation. The inventors also appreciate that tools which attach to these tower assemblies that are used to shape clay often damage the clay and form it into a non-appealing shape because of their tenancy to pull the clay outward, against the direction of force imparted by rotation. Further, prior art tools that push from the outside of the clay to form the desired shapes tend to embed into the clay, and destroy the workpiece. Additionally, it is noted that prior art pottery wheels and their attachments do not allow for an easy and effective way making micro adjustments to the tools used to sculpt the clay. Collectively, these problems often result in a negative user experience when using prior art pottery wheels.

In accordance with embodiments of the invention, a pottery wheel with an improved throwing arm that pushes the clay towards the center of the spinning plate, with the throwing arm providing an inward force towards the direction of motion, is disclosed.

The pottery wheel may comprise a housing, a rotary motor within the housing, a spinning plate attached on a upper surface of the housing powered by the rotary motor configured to spin in at least one direction, at least one grip on a lower surface of the housing, an improved a throwing arm mounted to the upper surface of the housing outside the radius of the spinning plate, where the throwing arm is configured to pivot around a first point in two directions with at least one direction being towards the center of the spinning plate, where the throwing arm is configured to pivot around a second point in two directions with at least one direction being towards the center of the spinning plate, with the throwing arm being configured to attach to at least one tool.

The pottery wheel may comprise a plurality of grips located on the lower surface of the housing. The grips may be made of rubber or other material which provides high traction on a variety of surfaces. The grips may be patterned as to apply increased pressure at certain points along the surface of the grip in order to improve traction with the contacting surface.

The pottery wheel may have a switch for adjusting the speed and direction of the spinning plate and rotary motor. The switch may have three or more settings including off, and may be continuously adjustable from the minimum to the maximum speed using a dial or other similar switch. The rotary motor and spinning plate should be configured to run at full speed in both the clockwise and counterclockwise directions in order to accommodate sculptors who are both right and left handed. The motor may be a standard 24-volt motor with a power of 120-150 watts configured to rotate at 180 rotations per minute.

The spinning plate may have demarcations on it in order to help guide the sculptor when placing the clay on the wheel and manipulating it. The demarcations may be in circular in shape and run from the circumference of the plate to the center. They demarcations may be evenly or alternatingly spaced apart with numbers indicating standards distances.

The housing may be shaped to have one or more raised arches, ends or edges which may provide additional stability, structure, and manipulation points. The housing may also have one or more indentations or grips located on the housing to provide additional stability, structure, and manipulation points.

The improved throwing arm configured may be able to pivot about two points. The first pivot point may be located below the second pivot point. The first pivot point may allow the throwing arm to pivot across the face of the spinning plate in a plane parallel to the face of the spinning plate. The second pivot point may allow the throwing arm to pivot towards and away from the face of the spinning plate. The pivot points collectively may provide at least four directions of motion in which the arm can be manipulated. The improved throwing arm further may be detachable from the housing, and may screw in, snap in, attach by friction fitting, or other means. On the length of the throwing arm, a third pivot point may rotate along the axis defined by the length of the throwing arm, may lock into place about the third pivot point at prescribed angles, and may be spring loaded about the third pivot point. A second throwing arm may be mounted to the upper surface of the housing outside the radius of the spinning plate. Additionally, two throwing arms may be used in synchronicity and simultaneously to form the inside and outside diameter of the vessel or sculpture at the same time.

The throwing arm may be configured to allow for the attachment of various tools to the throwing arm. It may comprise one or more attachment points located in the center of the arm which are designed to line up with the center of the spinning plate. It may also comprise one or more ridges or slots defined by a series of ridges which run the length of the arm to allow for attachment of various tools anywhere along the length of the throwing arm. The tools configured to attach to the throwing arm may attach at a 90-degree angle relative to the throwing arm, and may comprise a centering pin and protrusion points which facilitate attachment to the throwing arm.

The spinning plate may be removable from the housing, which may facilitate easier cleaning of the unit. The housing may further comprise a structure to capture the overflow of water from the spinning plate, such as a catch tray positioned below the spinning plate. The housing may be configured to prevent any water from the surface of the spinning plate from entering into the housing and contacting any electrical components.

In the application where the improved pottery wheel is designed for children, a smaller rotary motor with less power, torque, and fewer rotations per minute may be used. Further, there may be a torque limiter which will limit the maximum torque applied by the motor, as well as an emergency shut off switch attached to the motor. The emergency shut off switch may activate automatically in response to a specified condition, such as a lack of rotation or an increase in torque beyond a specified limit. In addition, a different shaped housing may be used which may have additional arches, ridges, and grips as to accommodate children's smaller and less dexterous hands. The spinning plate may also not be removable in the children's pottery wheel as to prevent children from reaching into the housing and damaging the interior components.

BRIEF DESCRIPTIONS OF DRAWINGS

DETAILED DESCRIPTION

In accordance with the teachings of this disclosure, a pottery wheel with an improved throwing arm that pushes the clay towards the center of the spinning plate, in an arc shaped motion, with the throwing arm providing an inward force towards the direction of motion and towards the axis of rotation, that also allows for micro-adjustments to be easily made, is disclosed.

Figure 1:
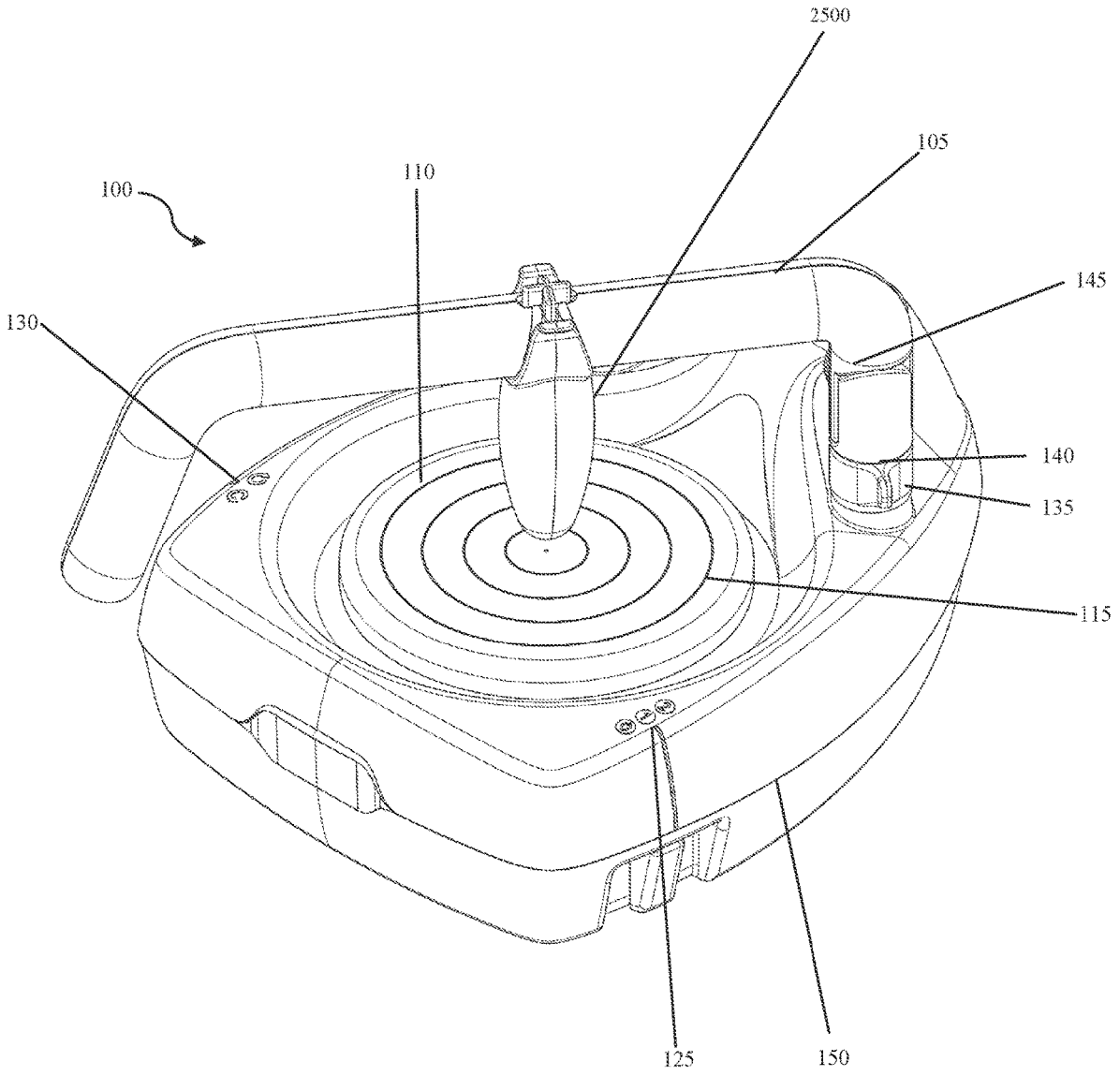
FIG. 1 shows a downward perspective view of a children's pottery wheel of present embodiments.
Figure 14:
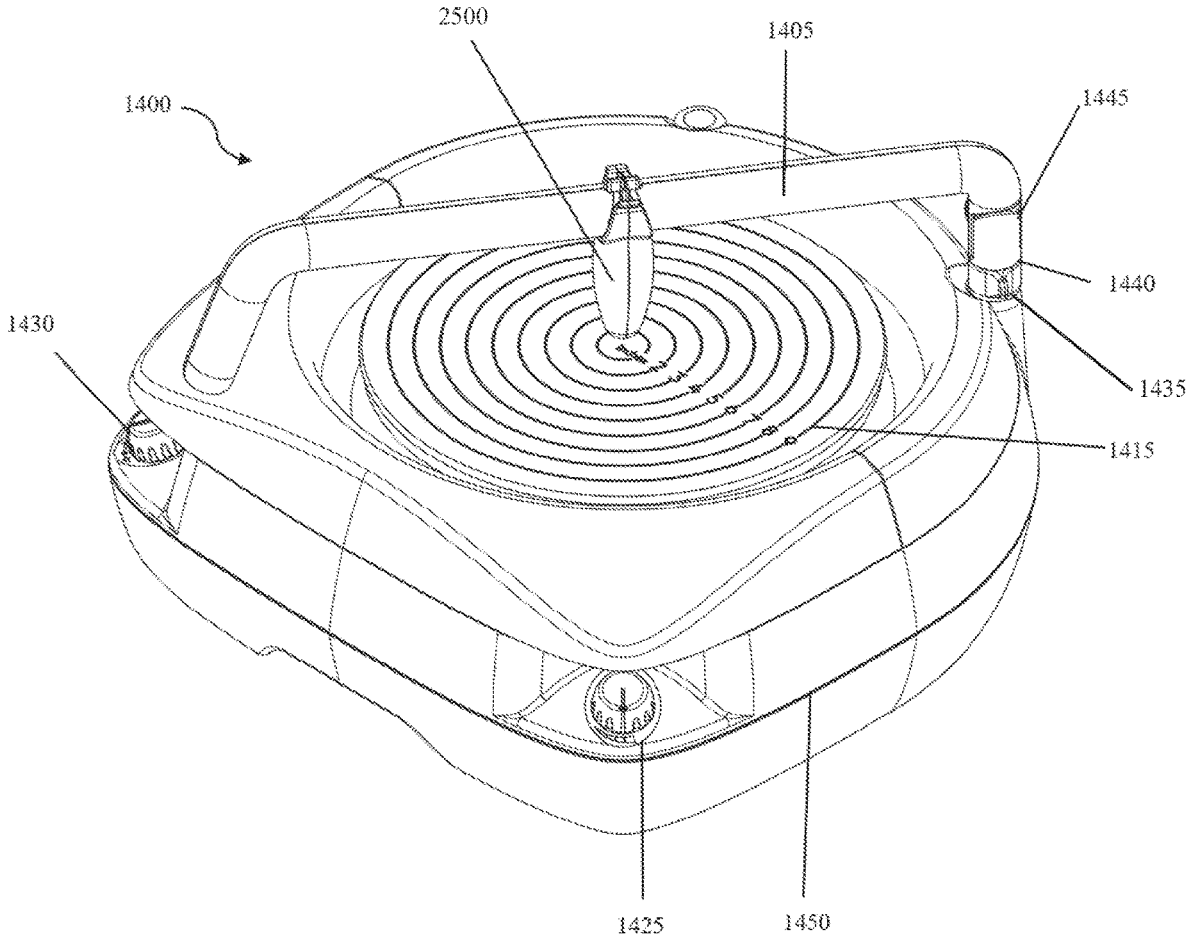
FIG. 14 shows a downward perspective view of a pottery wheel of present embodiments.

FIGS. 1 and 14 show pottery wheels of present embodiments. FIG. 1 shows a children's pottery wheel 100 of present embodiments while FIG. 14 shows a hobby pottery wheel 1400 of present embodiments intended for use by adults.

The pottery wheels may comprise a housing 150/1450 encasing a rotary motor upon which a spinning plate 110 is attached. The motor may be attached to switches on the face of the housing which control the speed and direction of the motor. The children's pottery wheel may use button style switches 125/130 for speed and direction, while the hobby pottery wheel may use dial type switches 1425/1430 for speed and direction which allow for the continuous adjustment of speed to many different settings. Though a circular spinning plate is pictured in FIGS. 1 and 14, a plate of a different shape may be used, such as an octagon or other polygon, and present embodiments are not necessarily limited to a circular spinning plate. The spinning plate may have one or more demarcations 115/1415 on the surface of the plate which will help the user to position the clay upon the plate, guide the position of the tools, and assist in sculpting the clay.

The pottery wheels may further comprise a throwing arm 105/1405 placed on the upper surface of the housing 150/1450, but outside the perimeter of the spinning plate 110/1410. The throwing arm may have a first generally vertical section comprising two pivot points, a rounded curved portion which leads into a generally horizontal section which extends across the length of the housing 150/1450, and a second rounded curved portion which leads into an angled handle, and terminating in a rounded tip. The handle may be ergonomically shaped and an appropriate size to be gripped by the hand of a child in the children's pottery wheel, and an appropriate size for an adult hand in the hobby pottery wheel. The throwing arm 105/1405 may be removably attached to the housing at an attachment point 135/1435, and may attach using a variety of different methods including a friction fitting, a flexible structure which snaps into place, screwing in, being secured by a clip or other fastener, or any other method of fastening known within the art.

The throwing arm may comprise one or more pivot points, and may preferably comprise a first pivot point 140/1440 and a second pivot point 145/1445. In the embodiments of FIGS. 1 and 14 wherein the throwing arm comprises two pivot points, the throwing arm may be configured to move about each pivot point in at least two directions, having a total of at least four directions of motion. This may define an arc shaped motion for the arm and the attachments. It may be desirable for the throwing arm to pivot about each pivot point in only two directions as to provide increased stability when manipulating the throwing arm.

In an alternative embodiment of the throwing arm, it may further comprise a third pivot point located at the beginning of the horizontal segment of the throwing arm which allows the centering arm to be rotated by the user twisting the throwing arm, possibly at the handle. This third pivot point may be spring loaded as to restore the throwing arm to a neutral position once the twisting force is removed. The third pivot point may also lock along the axis of rotation such that the throwing arm can be locked in a horizontally turned position, with a sculpting attachment pointing in a direction parallel to the face of the plate. This may allow for greater variability and movement of the centering arm and attached tools, allowing a user to sculpt the clay in additional ways. For example, when locked in such a horizontal orientation, the side of the sculpting attachment can be used to push the recently centered clay downwards, flattening the wobbly top of the clay, removing bubbles and dry spots in the clay, and uniformly moistening the clay.

There are also further embodiments of the throwing arm which allow even greater versatility when sculpting clay. In once such alternative embodiment, the centering arm may itself be a lever, with the handle at the end of the throwing arm which pushes a rod inwards toward the clay. In another possible embodiment, there may be two throwing arms attached to the housing, possibly one in the left-handed centering arm attachment point and one in the right-handed attachment point. In such a dual throwing arm embodiment, you may be able to use the opening tool inside and a forming tool on the outside to simultaneously to lift the clay into a form using coordinated arm motions. Further, there may be a linkage between the two arms which is stabilized by mounting points at a distance from the center of the spinning plate, that reduces translation of the motion from user's hands on the arms to only minute movements on the clay.

The pottery wheel and the throwing arm 105/1405 may be configured to allow for the attachment of a variety of tools to the throwing arm, including the opening tool 2500 pictured in FIGS. 1 and 14. The throwing arm may comprise a plurality of attachment points on the generally horizontal length of the throwing arm, possibly located precisely in the middle of the throwing arm. Alternatively, the generally horizontal length of the throwing arm itself may be an attachment point which allows for the attachment of tools to the centering art at any point along the horizontal length of the arm. The throwing arm may comprise a particular set of attachment points located exactly in the center of the throwing arm, which is positioned directly above the center of the spinning plate as to allow for improved centering of clay, and precise manipulation of the clay around the center point of the spinning plate. This may include a centering pin receiving channel and receiving holes which facilitate attachment of tools in the middle of the throwing arm.

The first pivot point 140/1440 may be situated below the second pivot point 145/1445, or vice versa. The first pivot point 140/1440 may be configured to allow the throwing arm to move in two directions with at least one direction being towards the center of the spinning plate. The first pivot point may allow for the throwing arm to sweep across the surface of the spinning plate in a plane parallel to the surface of the spinning plate, as to provide access to the clay at any point on the surface of the spinning plate. The throwing arm may have a hard-stop lock at the horizontal contact point so that the attachment of the opening tool 2500 remains approximately 0.25 inches above the spinning plant. In some embodiments, it is possible that the throwing arm can be locked at a particular location along the first pivot point, restricting further motion.

The second pivot point 145/1445 may be situated above the first pivot point 140, or vice versa. The second pivot point 145/1445 may be configured to allow the throwing arm to move in two directions with at least one direction being towards the center of the spinning plate. The second pivot point 145/1445 may allow for the throwing arm to moved towards and away from the face of the spinning plate, in a direction which intersects the face of spinning plate, which may be described as intersecting or generally perpendicular to the face of the spinning plate. In some embodiments, it is possible that the throwing arm can be locked at a particular location along the second pivot point, restricting further motion.

Collectively, the two pivot points may an arc shaped motion defined by four directions of motion: right and left across the face of the spinning plate, parallel to the face of the spinning plate; and towards and away from the face of the spinning plate, generally perpendicular to the face of the spinning plate. When combined with the positioning of the throwing arm located above and across the entire face of the spinning plate, and the attachments which can be placed along the generally horizontal length of the throwing arm; the pottery wheel and throwing arm assembly provides a wide variety of stabilized movements that can assist sculptors of all experience levels in gently sculpting the clay rotating on the spinning plate into a variety of different final products.

This configuration of a generally trapezoidal shaped the throwing arm removably anchored a short distance outside the perimeter of the spinning plate wherein it pivots in four directions with at least two directions being towards the center of the plate represents a significant improvement over prior art pottery wheels which fail to allow for the easy and gentle manipulation of clay by users of all experience levels, including children. The availability of attachment points along the throwing arm, and in the center of the throwing arm, also is a significant improvement over prior art pottery wheels which fail to provide an easy and effective means of centering and manipulating clay about the axis of rotation.

The configuration of a throwing arm extending across the length of the pottery wheel that pivots in four directions with at least two directions being towards the center of the plate also represents a significant improvement over prior art in that it allows for the improved centering of clay blocks about the axis of rotation precisely in the middle of the centering plate. In general, positioning a block of clay precisely in the middle of the spinning plate is among the greatest challenges for new sculptors when using a pottery wheel, as even a small distance off center leads to an uneven application of force to the perimeter the clay as it rotates about the axis of rotation, in the center of the plate, resulting in an asymmetric and aesthetically unappealing product.

When attempting to mitigate the effect of an off centered round of clay, many prior art pottery wheels and attachments require the user to pull the clay outward against a tool pushing inward in an attempt readjust the shape of the clay so that the new shape is generally in the center of the spinning plate. However, when pulling the clay outward and against the direction of motion, it is very easy to damage the clay as the tools used to manipulate the clay are much harder than the clay, and when combined with the force of rotation imparted by the motor, the clay often breaks into several pieces, destroying the instant work, and usually requiring the clay to be repurposed into another, smaller work.

The present disclosure solves these problems in numerous ways which include, but are not limited to, the use of a throwing arm extending across the length of the pottery wheel that pivots in four directions with at least two directions being towards the center of the plate, to assist in centering the clay mass. When the round of clay is rotated about an axis at the center of the spinning plate, the circular force can be described as having two components: centripetal force that pulls the clay inward towards the axis of rotation, and linear force which pushes the clay outward from the spinning plate in a direction orthogonal to the radius of the spinning plate and direction of centripetal force.

The throwing arm provides a force which runs against the direction of the linear force and parallel to the centripetal force, pushing the clay against the direction of rotation, and towards the center of the spinning plate and clay mass. This is an improvement relative to pulling the clay in a direction parallel to the linear force, away from the center of the spinning plate, and outward from the center of the clay mass. Because the clay is pushed towards its center of mass and not pulled away from it, the clay block does not have the propensity to rupture in the same manner as it does when the clay is pulled outward and away from the center of the clay mass. This is desirable because it allows for a mass of clay which is been mispositioned to be gently moved to a more centered position in a manner which is unlikely to rupture the clay and damage the appearance of the final product.

The present disclosure also improves the user experience when sculpting clay on a pottery wheel in numerous ways which include, but are not limited to, the use of a trapezoid shaped throwing arm extending across the length of the pottery wheel that pivots in four directions to make micro-adjustments to sculpting tools. By providing a rigid and easily maneuverable structure that is anchored at a point at the far side of the pottery wheel, which extends over the entire mass of clay at an upward angle, adjustable about the pivot points, and terminating in a tip suitable for gripping at a near side of the pottery wheel; significant leverage is created over the clay positioned below the horizontal structure of the throwing arm. In another alternative embodiment, the throwing arm may comprise a linkage system to further increase the leverage it places on the clay.

Due to this leverage, large motions on the near side of the throwing arm translate to smaller motions at the middle of the throwing arm. This leverage allows for precise movements and micro-adjustments to be made to the throwing arm and its attachments even by unskilled individuals who may lack fine motor skills, as inadvertently large motions to the tip where the throwing arm is gripped will be translated to only small motions in the middle of the arm where the sculpting tools are attached. Because the spinning plate has the potential to rotate the clay at high speeds, even very small movements of the any tools or attachments in contact with the clay can significantly alter the look of workpiece. In at least this manner, this disclosure addresses solves the problem of being unable to easily make micro-adjustments to sculpting tools in contact with the clay, which is a significant challenge associated with sculpting on a pottery wheel.

The ability to easily and reliably make micro adjustments to sculpting tools in contact with clay on a pottery wheel using the throwing arm of present embodiments is further enhanced by the two pivot points which establish arm arc shaped movement, defined four directions of motion. By anchoring the throwing arm at a far end of the pottery wheel and controlling its motion in the up and down, and left to right directions; the manner in which the sculptor is able to move the clay using the throwing arm is limited. The sculptor must think about how they will move the tool using only the four available directions in order to achieve the desired result. By limiting the manner in which the clay can be manipulated by the throwing arm and tool, i.e. by using the throwing arm about the pivot points or moving the sculpting tool along the throwing arm, it forces the sculptor to be slower and more deliberate in their motions, generally resulting in an improved product.

The ability to easily and reliably make micro adjustments to sculpting tools is also enhanced by the use of 2 pivot points which limit the directions in which the throwing arm could be moved inadvertently, especially by individuals lacking fine motor skills. This allows for improved manipulation of the sculpting tools attached to the throwing arm and in contact with the clay, by providing better control over the motion of the arm about the pivot points, and generally preventing any motion in the forward or backward directions due to the throwing arm being anchored to the housing. In order to adjust the throwing arm along the forward or backward directions, the sculpture must instead move the sculpting tool along the throwing arm, or use their hands to assist, as opposed to moving the throwing arm itself back and forth. Further, in an alternative embodiment wherein the throwing arm can lock its pivot points to fix them at a particular location, it is possible that the throwing arm can be restricted to only two directions of motion about a single pivot point, further limiting inadvertent manipulations to the clay.

In the embodiments of the children's pottery wheel, the rotary motor may comprise a torque limiter and emergency shut off switch as added safety features to make the device safer for children. The torque limiter may disengage the rotary motor if a torque above a certain value is detected. Further, the motor in the children's pottery wheel may be a low power and low speed motor, only going up to a maximum speed of about 80 RPM as opposed to the hobby pottery wheel which may have a maximum speed of up to 180 RPM and run off of 6.5 A current. High end pottery wheels may have a speed up to 300 RPM. The motor may compose a crush mechanism in the gear box.

It is possible that the spinning plate of the pottery wheels of present embodiments may be removable from the housing. The spinning plate may be attached to the rotary motor by a star index, which firmly attaches the driveshaft to the spinning plate, or any other fitting which firmly attaches the drive shaft to the spinning plate. The spinning plate may snap in and out of the housing, be released by pressing a switch or button which withdraws an extension member from a corresponding slot in the spinning plate, or be removably attached by other means known within the art. The extension member may be spring loaded such that a restoring force is provided once the displacing force is removed. The removal of the spinning plate from the housing may facilitate easier cleaning of the pottery wheel and removal of clay from in between the edges of the spinning plate and the housing.

It is also possible that the spinning plate may split apart into two pieces to facilitate easier removal. This may be especially useful in cases where the drive shaft of the motor is permanently attached to a portion of the top wheel or spinning plate, possibly in a hobby pottery wheel which uses a higher-powered motor. In the embodiment for a children's pottery wheel, the spinning plate may not be removable as to prevent children from gaining access to the internal components.

The pottery wheels of present embodiments may further comprise a catch tray located below the spinning plate to catch any clay or water that gets caught in between the spinning plate and the housing, and falls into the housing. The catch tray located below the spinning plate may also be removable to allow for easier cleaning and access. It may have a hole or opening in the center of the catch tray which allows for the drive shaft to pass through it and attach to the spinning plate. The catch tray may have a diameter larger than that of the spinning plate and extend closer to the edge of the housing in order to catch falling pieces of clay and water which fall through the pottery wheel.

The pottery wheels of present embodiments may further comprise a drainage path for the water to flow out of and away from the wheel. The drainage path may comprise one or more channels located around and spinning plate which direct the water outside of the housing. There may be more than one drainage path, and there may be a secondary drainage path located below the spinning plate and catch tray which directs excess water into one or more channels, away from motor, and disposing it outside of the housing. The exterior component of the motor and electrical components of the pottery wheel may be configured to be water resistant by coating the surface with rubber, plastic, a polymer, or other water-resistant material to prevent a short in the event water does come into contact with an electrical component.

In an alternative embodiment, it is possible that the pottery wheel may further comprise a sliding track located about the rear end of the housing in which the throwing arm may slide from its right-hand position to its left-hand position. In such an embodiment, the throwing arm would not need to be removed from the housing in order to change from its right side to left side position. The throwing arm may move in the sliding track using ball bearings or wheels, or may slide without any additional structure providing assistance for the sliding movement, possibly by being manufactured to be the correct size to fit move within the sliding track but still provide some room for motion. In such an embodiment, the throwing arm may comprise a latch, switch, lock, or extension which fixes its position along the sliding track by sliding a protruding member into a receiving channel, firmly contacting the sides of the receiving channel to form a tight friction fit, or other means of securing a sliding member in place known within the art. The sliding track may be curved across the back end of the housing, arched, or straight.

Figure 2:
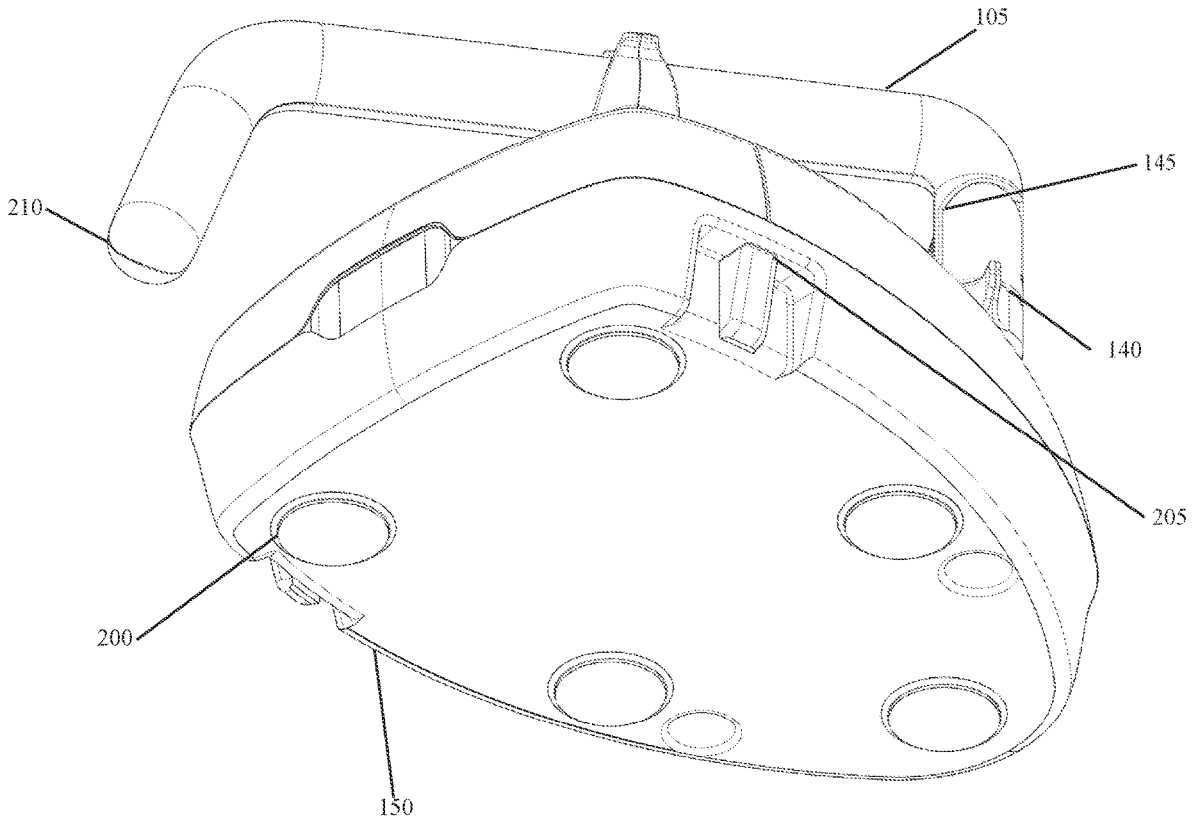
FIG. 2 shows an upward perspective view of a children's pottery wheel of present embodiments.

FIG. 2 shows an upward perspective view of a children's pottery wheel of present embodiments. Shown in this view are the throwing arm 105, the throwing arm handle 210, the upper portion of the throwing arm attachment 120, the first and second pivot points 140/145, grips 200 which provide traction between the housing and the surface upon which the pottery wheel is placed, and fasteners 205 positioned in a recessed section on the side of the housing. There may be a plurality of grips as is shown in FIG. 2, or there may be a single large grip which covers a larger area of the lower surface of the housing. The grips may be of any shape and need not be circular, and may comprise any patent on the grips to further enhance traction with the surface. The grips may be composed of rubber, an adhesive polymer, a surface with engineered roughness, or any other material which provides good traction with most surfaces. The grips may be patterned to improve traction. The patterned grips may also serve as sound dampening feet with multiple star-fish shaped feet that have varying geometry and may contact points on the surface of the grips. Alternatively, suction cups may be used as the feet to improve grip on smooth surfaces.

Figure 3:
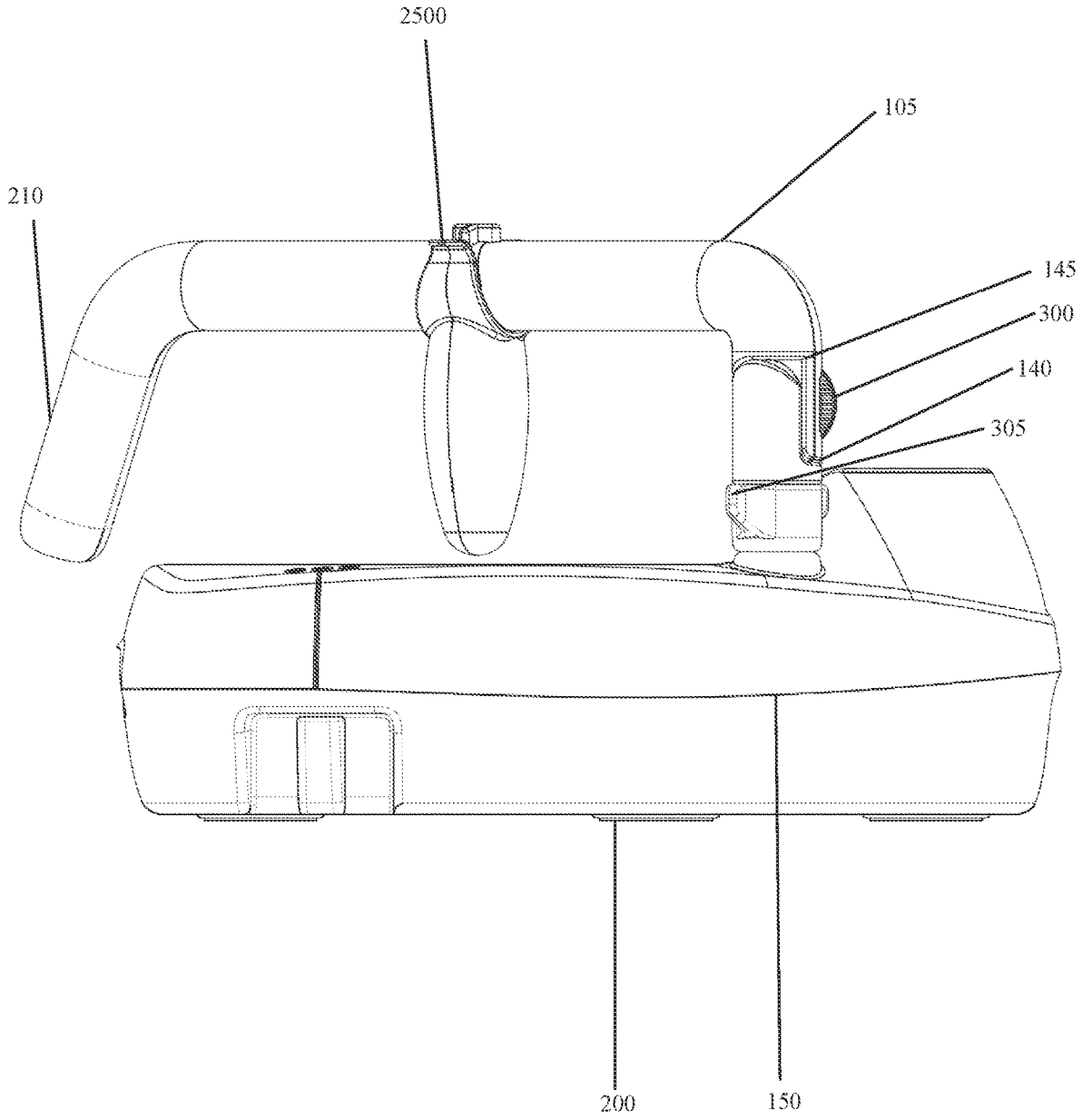
FIG. 3 shows a side view of a children's pottery wheel of present embodiments.

FIG. 3 shows a side view of a children's pottery wheel of present embodiments. Shown in this view is the throwing arm 105, throwing arm pivot points 140/145, a locking nut 300 which attaches the throwing arm and allows it to smoothly pivot up and down about the second pivot point 145, the generally vertical base of the throwing arm 105, the base fastener 305 which may anchor the throwing arm to the housing, the opening tool 2500, and the grips 200. The grips may have a moderate vertical profile such that the lower face of the pottery wheel is slightly raised off the ground. The grips may be sound absorbing and reduce the vibration and sound transferred to the surface upon which the pottery wheel is placed.

Figure 4:
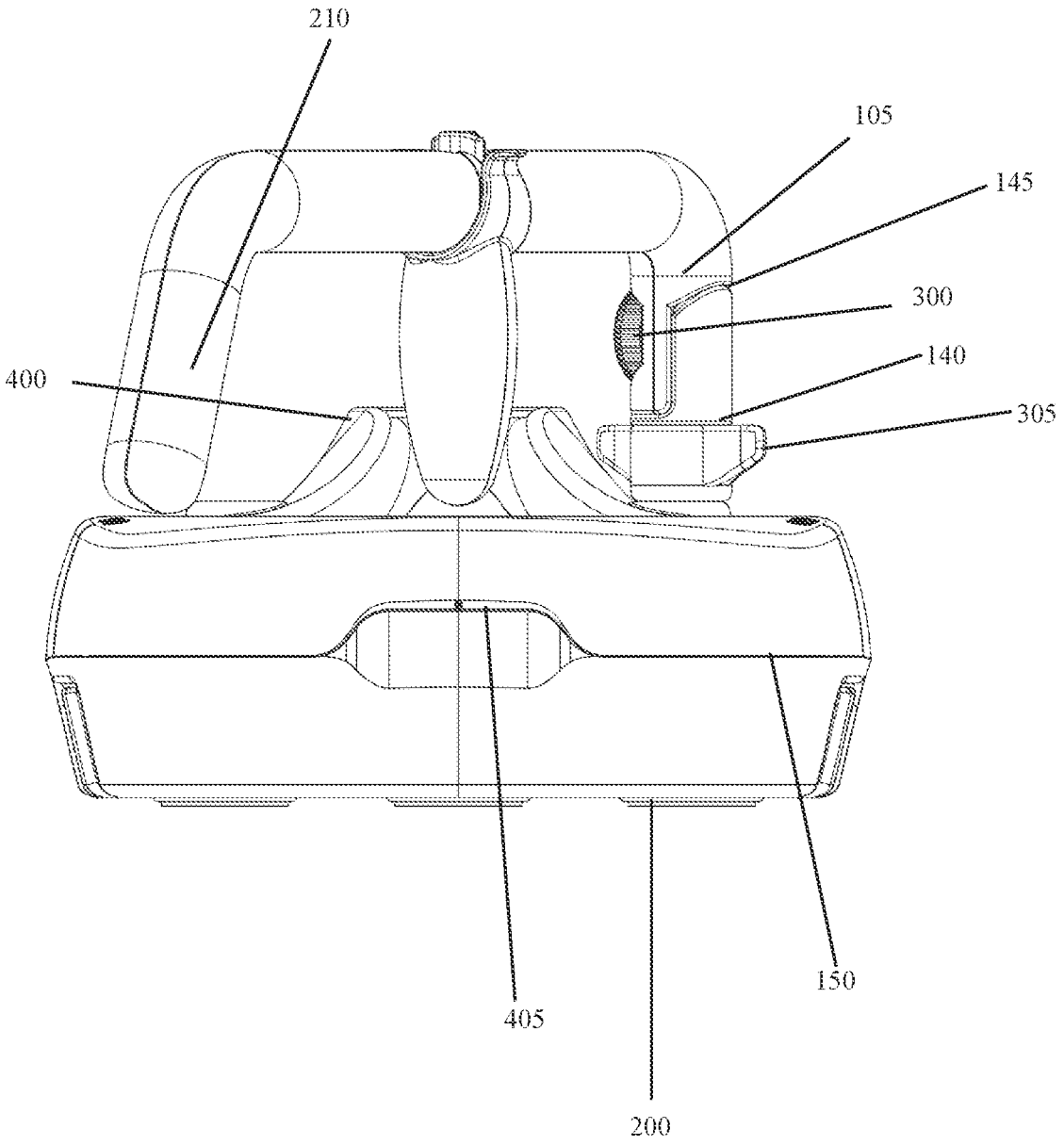
FIG. 4 shows a front view of a children's pottery wheel of present embodiments.

FIG. 4 shows a rear view of a children's pottery wheel of present embodiments. Shown in this view is the throwing arm 105, the throwing arm handle 210, the opening tool 2500, the locking nut 300, the base fastener 305, the rear recess 405 in the housing 105 suitable for serving as a hand grip, and the raised rear arch 400 on the housing.

Figure 5:
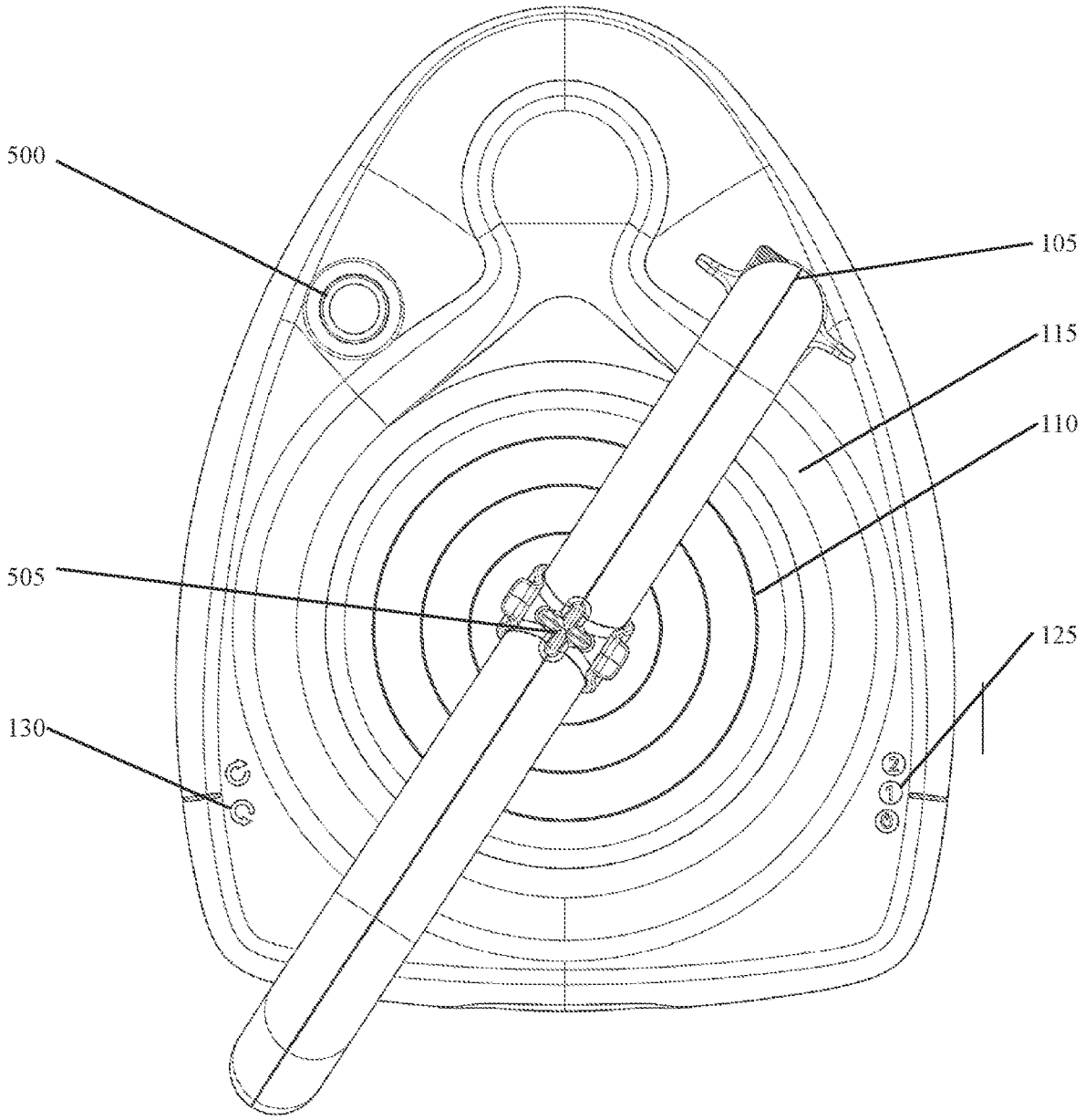
FIG. 5 shows a downward view of a children's pottery wheel of present embodiments.

FIG. 5 shows a downward view of a children's pottery wheel of present embodiments. Shown in this view is the throwing arm 105, the opening tool 2500, the centering pin 505 of the attachment which is inserted into the receiving channel of the throwing arm, the power buttons 125 for the motor which include a power on/off button, a low setting, and a high setting, the directional buttons 130 which include a clockwise setting and a counter clockwise setting, the spinning plate 110, the demarcations 115, and a left handed attachment point 500 for the throwing arm 105.

Figure 6:
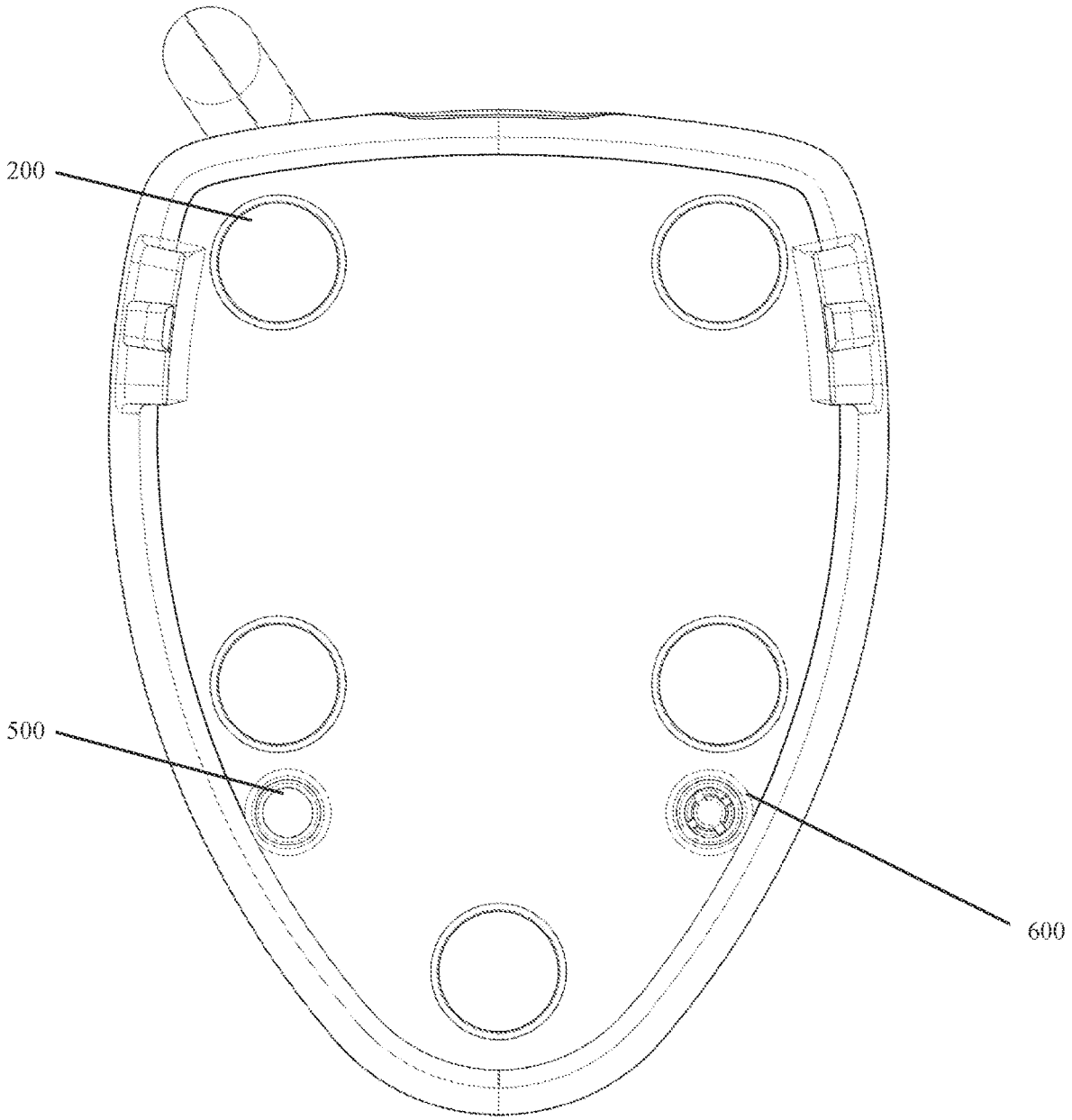
FIG. 6 shows an upward view of a children's pottery wheel of present embodiments.

FIG. 6 shows an upward view of a children's pottery wheel of present embodiments. Shown in this view are a plurality of grips 200, the left-handed attachment point 500, and the tip 600 of vertical base of the throwing arm, which is inserted into the housing.

Figure 7:
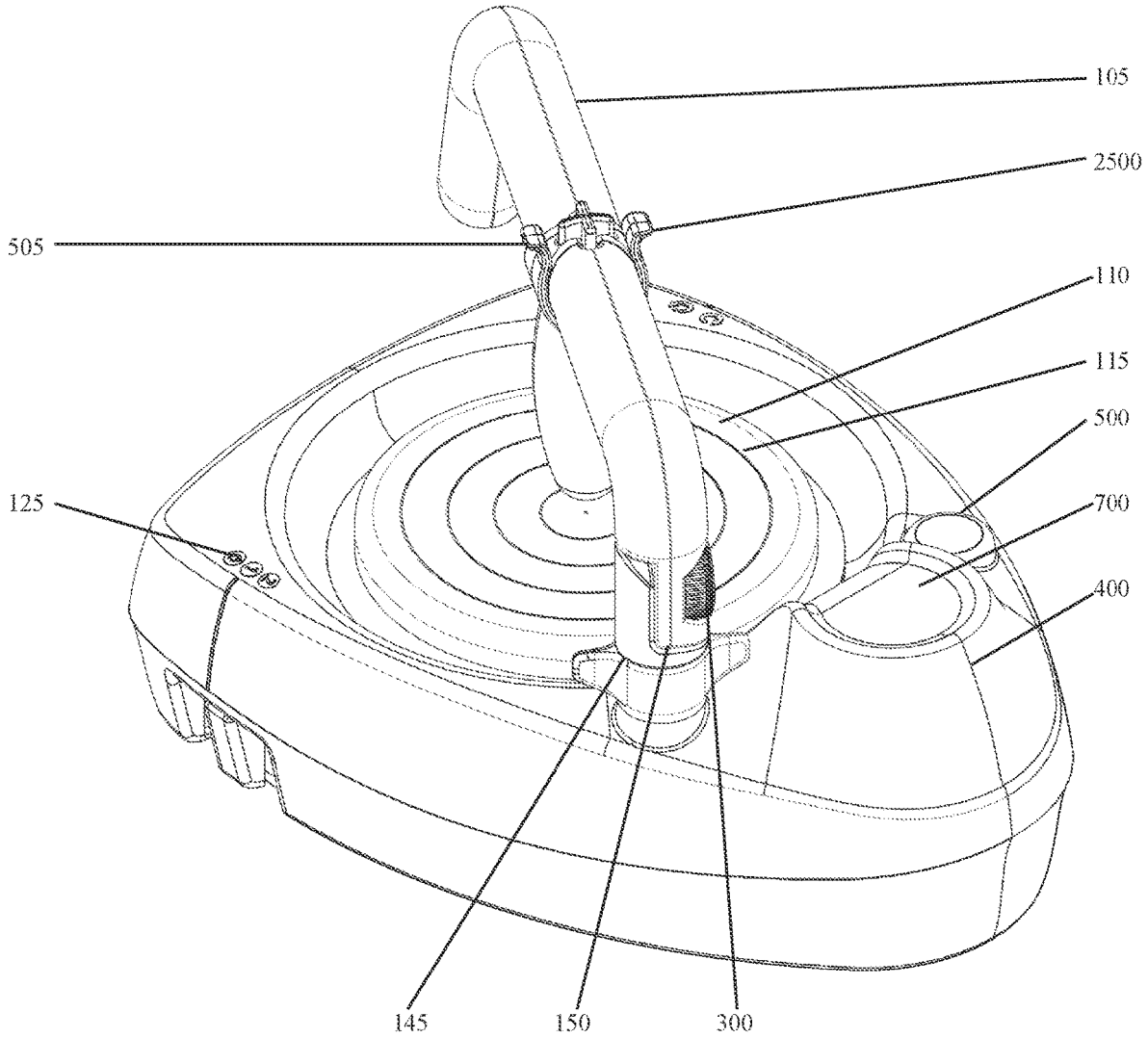
FIG. 7 shows an alternative downward perspective view of a children's pottery wheel of present embodiments.

FIG. 7 shows an alternative downward perspective view of a children's pottery wheel of present embodiments. Shown in this view is the throwing arm 120, the throwing arm attachment, the centering pin 505 of the opening tool 2500, the locking nut 300 which permits smooth rotation about the $2^{nd}$ pivot point 145, the first pivot point 140, the spinning plate 110, the motor power and directional switches 125/130, and the raised rear arch 400 of the housing 105. Also pictured is the flat platform which lies on top of the raised rear arch 400, suitable for resting the throwing arm or placing additional clay, as well as the left-handed anchor point 500 for the throwing arm 105, allowing it to be installed on the opposite side of the pottery wheel for use by a left-handed person.

Figure 8:
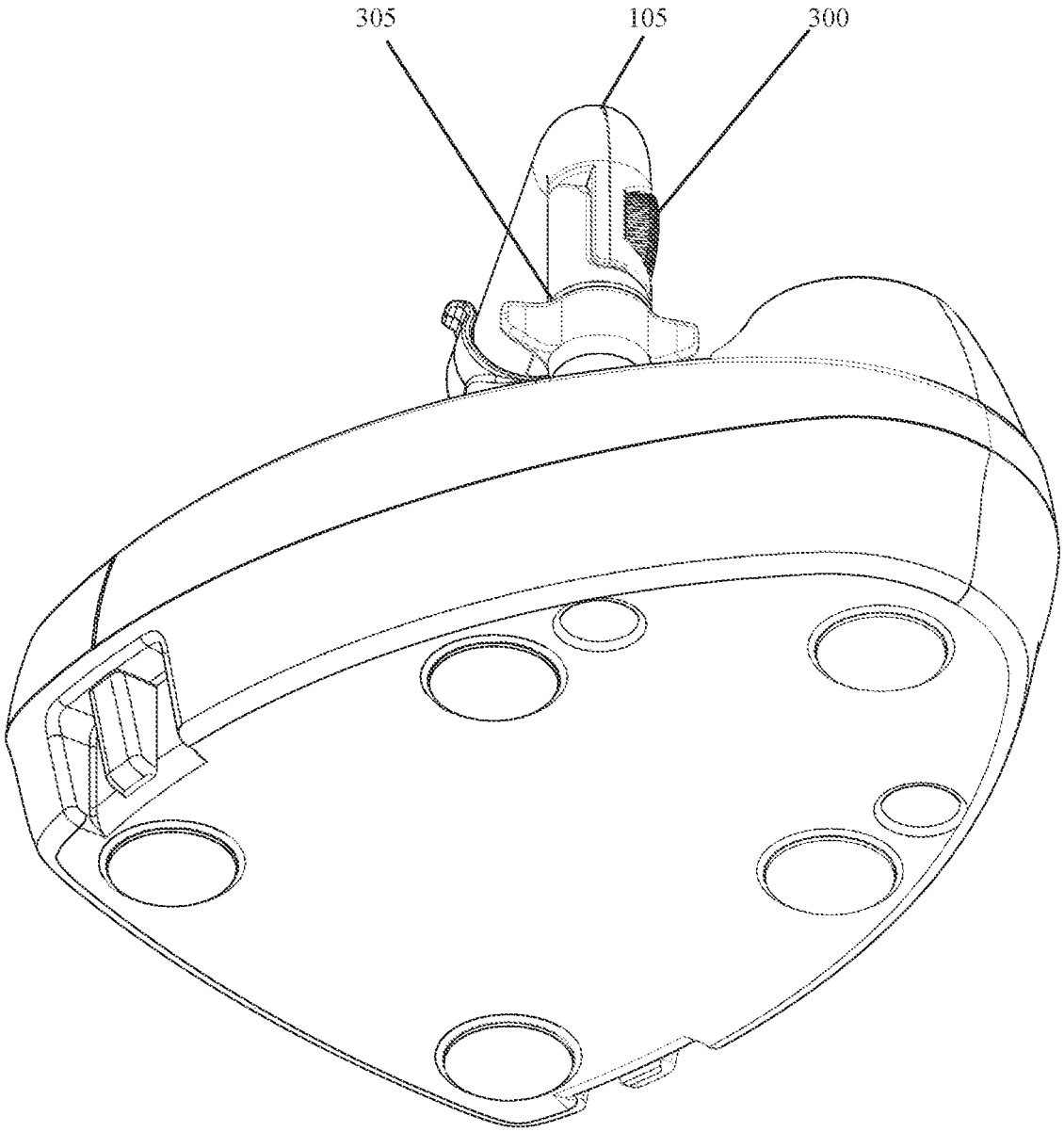
FIG. 8 shows an alternative upward perspective view of a children's pottery wheel of present embodiments.

FIG. 8 shows an alternative upward perspective view of a children's pottery wheel of present embodiments. Shown in this view are a plurality of grips, the locking nut 300, the throwing arm 105, and the base fastener 305 for the throwing arm.

Figure 9:
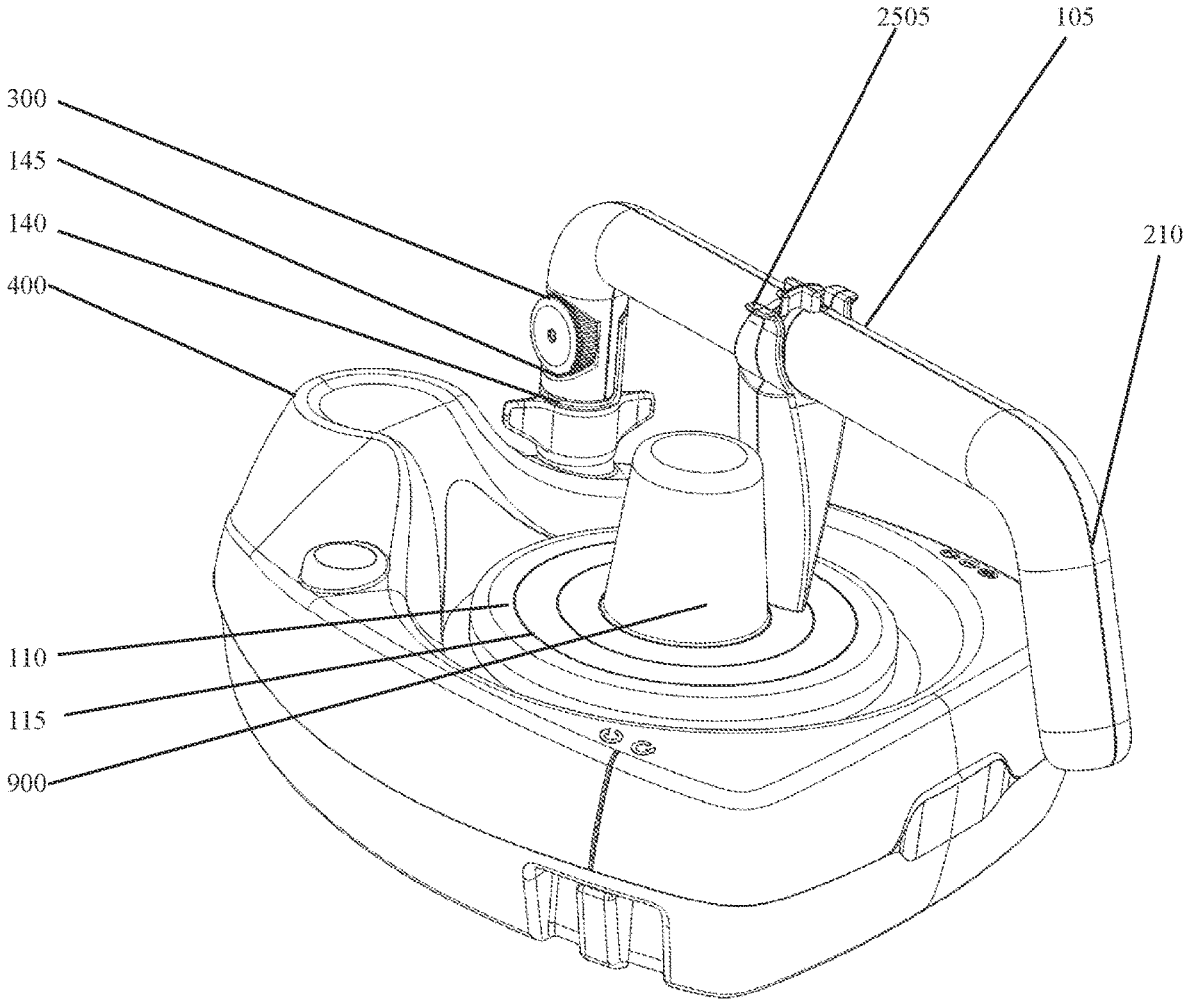
FIG. 9 shows an alternative downward perspective view of a children's pottery wheel of present embodiments with an attachment in use.

FIG. 9 shows an alternative downward perspective view of a children's pottery wheel of present embodiments with an attachment in use with a vessel of clay 900. Shown in this view is the housing 150, the throwing arm 105, the centering pin, the first and second pivot points 140/145, the raised rear arch 400, spinning plate 110, demarcations 115, power and directional switches 125/130, raised rear arch 400, and handle 210. Also shown in this view is the centering tool 2505 in use with a vessel of clay 900 being used to sculpt a smooth edge around the circumference of the clay.

Figure 10:
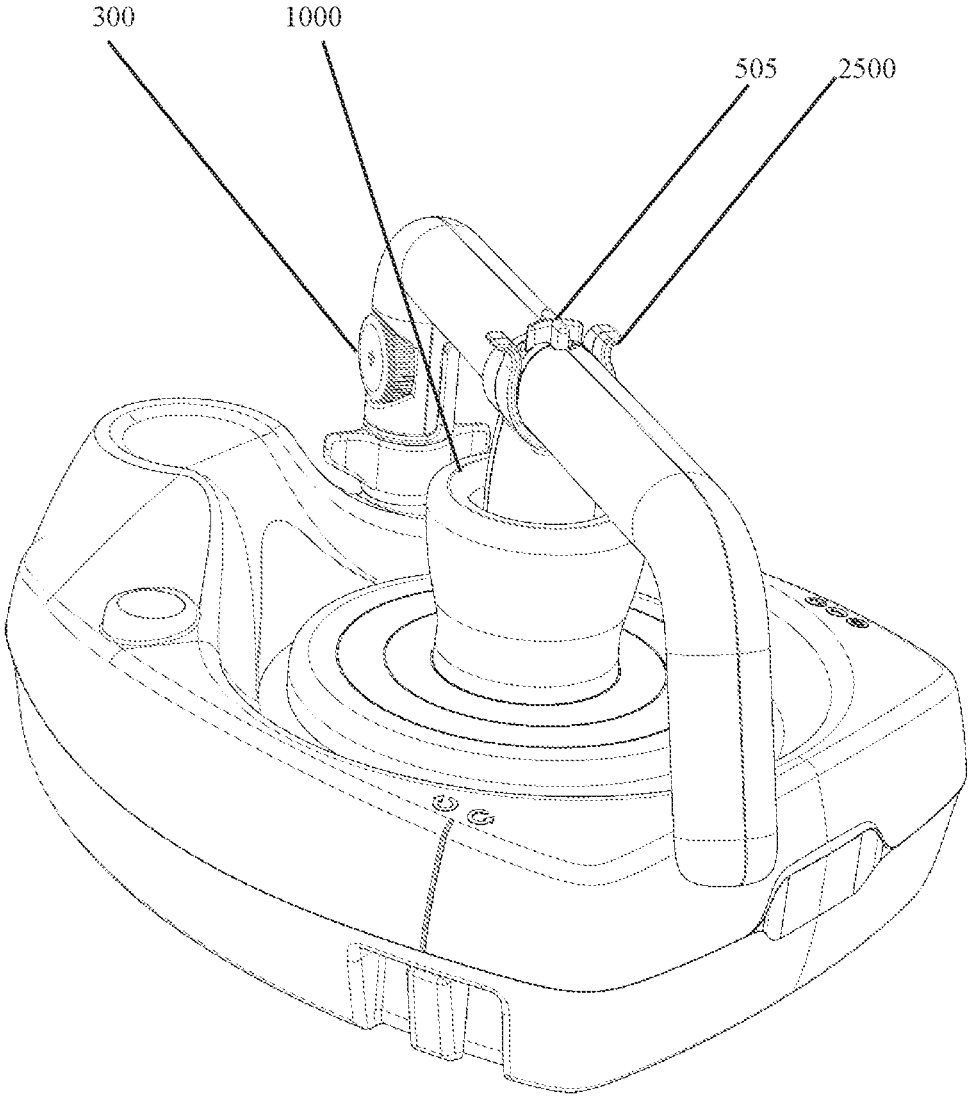
FIG. 10 shows an alternative downward perspective view of a children's pottery wheel of present embodiments with another attachment in use.

FIG. 10 shows an alternative downward perspective view of a children's pottery wheel of present embodiments with another attachment in use. Shown in this view is the housing, raised rear arch, the arch platform, the spinning plate, demarcations, throwing arm, centering pin 505, and locking nut 300. Also shown is the opening tool 2500 being used to hollow out the center of a pot shaped vessel of clay 1000.

Figure 11:
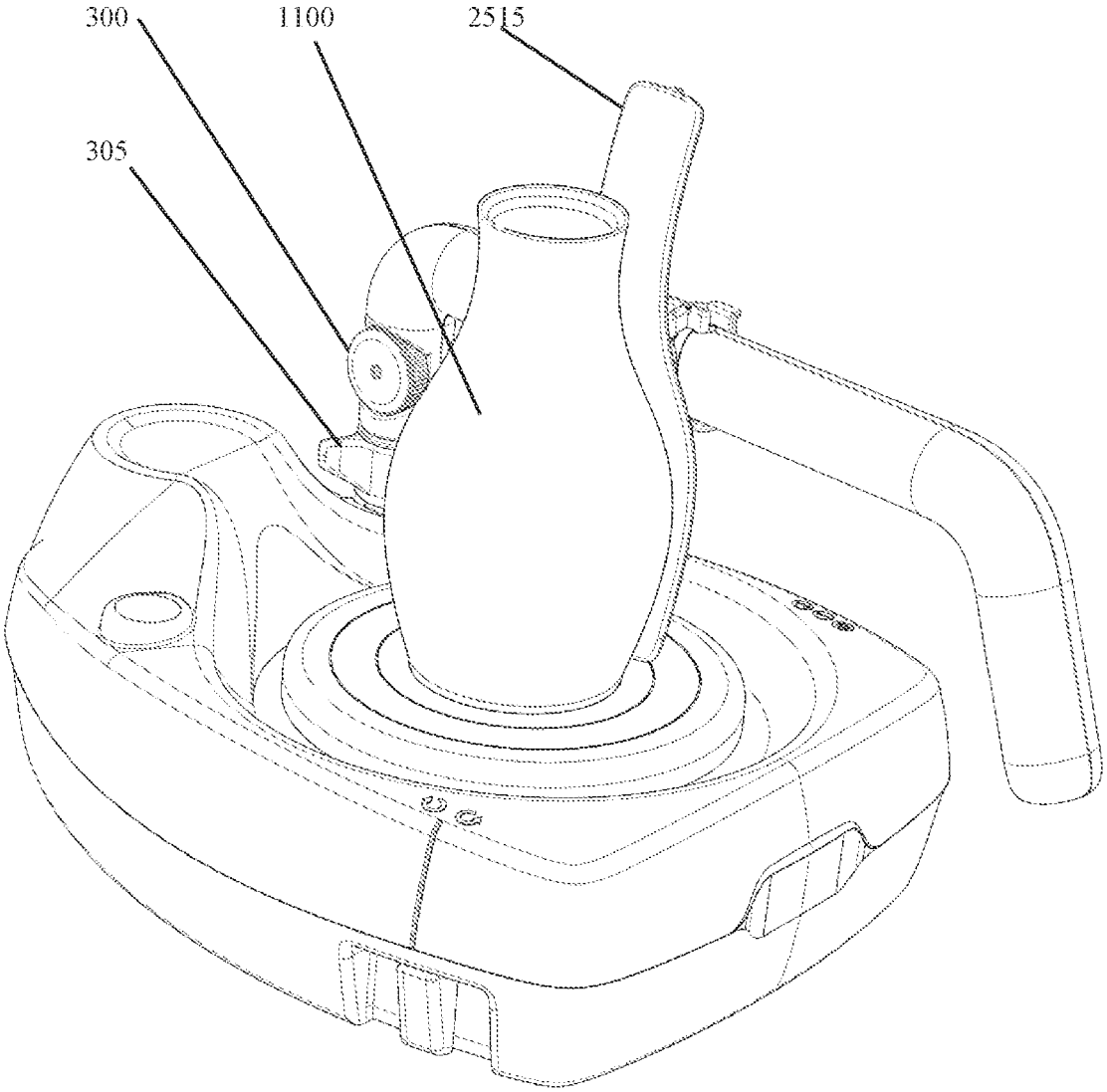
FIG. 11 shows an alternative downward perspective view of a children's pottery wheel of present embodiments with yet another attachment in use.

FIG. 11 shows an alternative downward perspective view of a children's pottery wheel of present embodiments with yet another attachment in use. Shown in this view is the housing, the throwing arm, the raised rear arch, the arch platform, the power and directional buttons, the spinning plate, demarcations, locking nut 300, and base fastener 305. Also shown is the curved edge vase forming tool 2515, and a vase shaped vessel of clay 1100.

Figure 12:
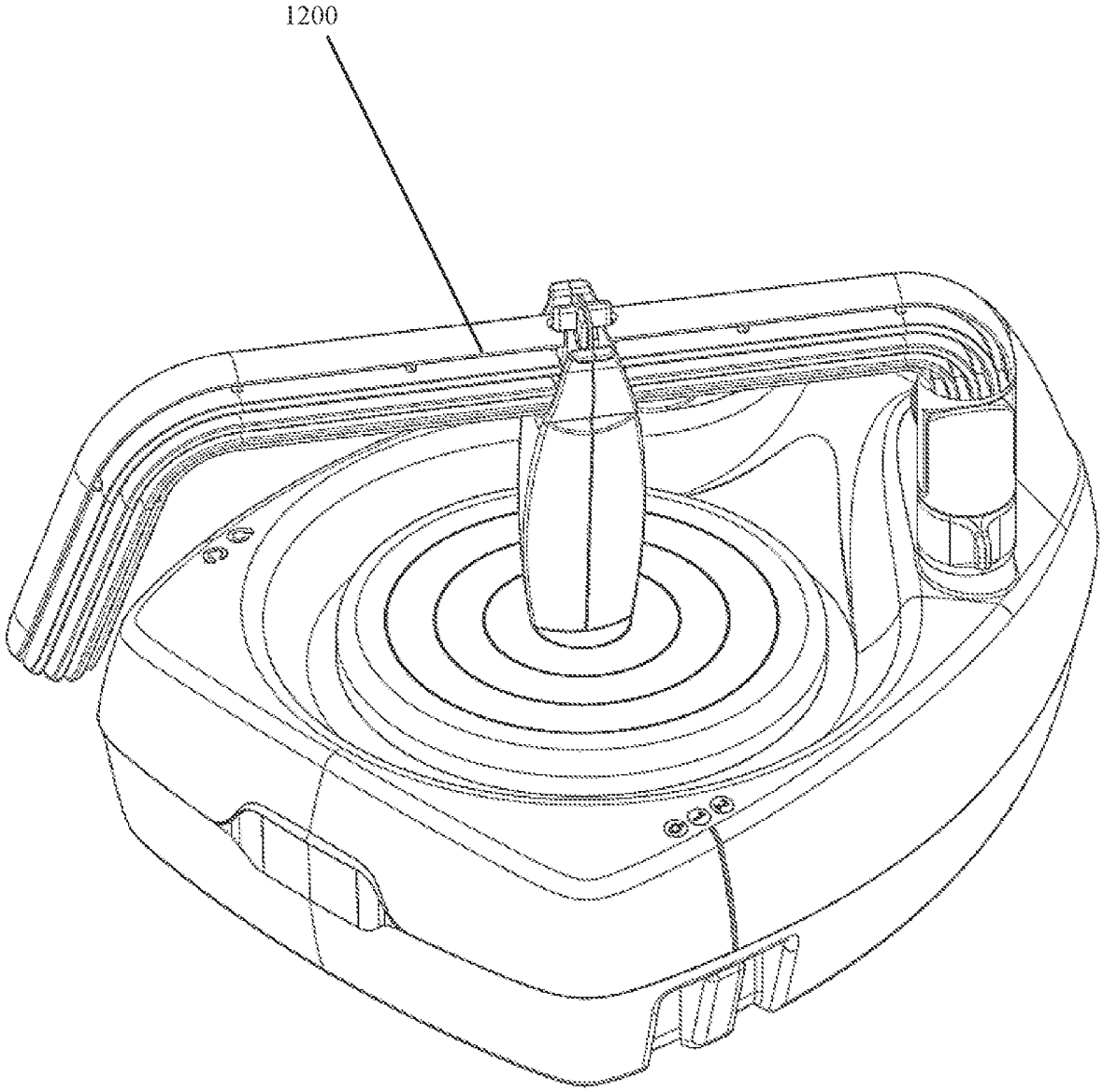
FIG. 12 shows an alternative downward perspective view of a children's pottery wheel of present embodiments with an attachment and additional features of the throwing arm are shown.

FIG. 12 shows an alternative downward perspective view of a children's pottery wheel of present embodiments with an attachment and additional features of the throwing arm pictured. Shown in this view is the housing, the throwing arm, the power and directional buttons, the spinning plate, demarcations, the centering pin, and base fastener. Also shown are a plurality of slots 1200 which are parallel to one another and run the length of the throwing arm. The slots may be suitable for attaching sculpting tools along the length of the arm at any point, as well as provide a surface with an enhanced grip for the user.

Figure 13:
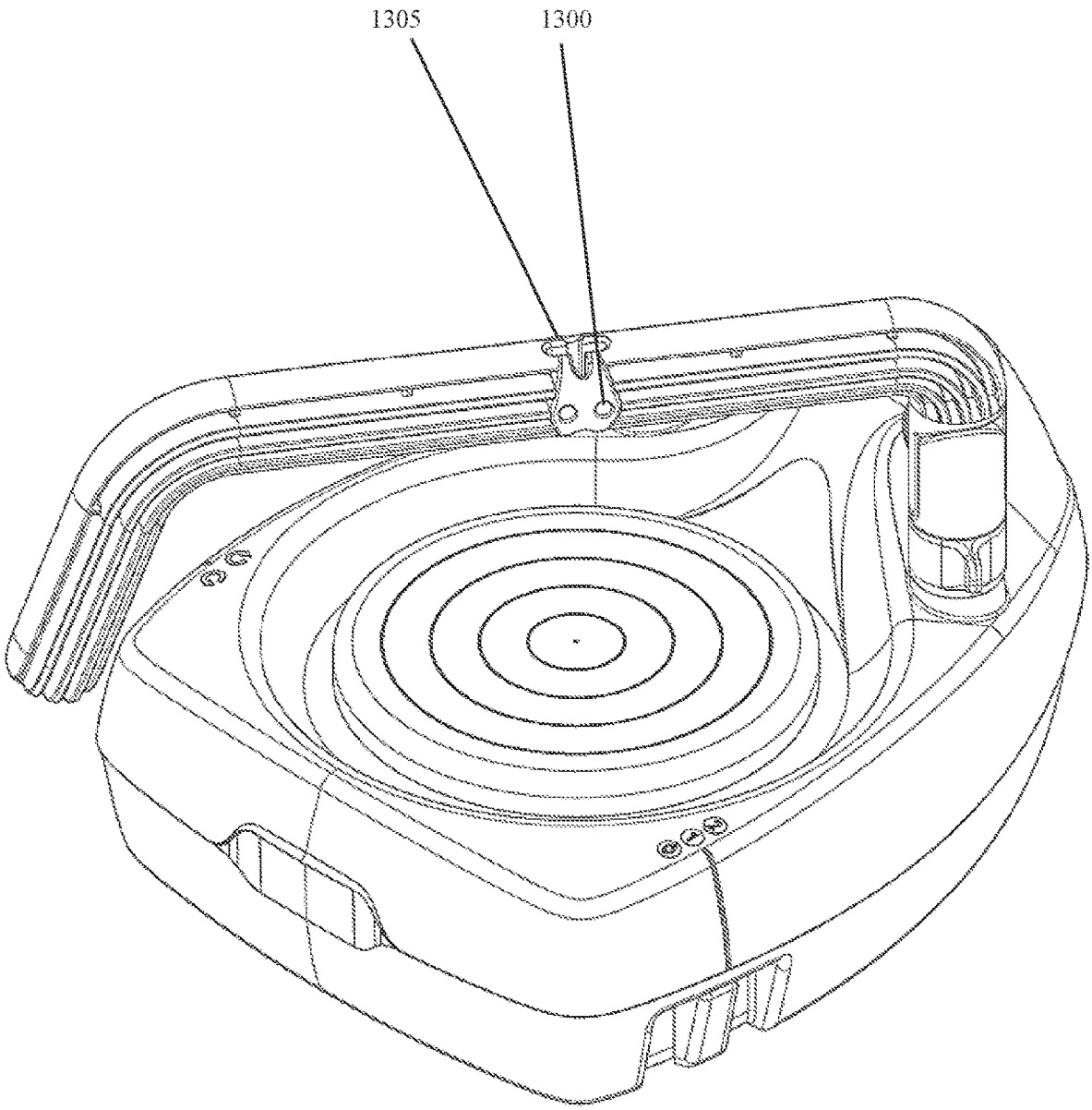
FIG. 13 shows an alternative downward perspective view of a children's pottery wheel of present embodiments without an attachment and additional features of the throwing arm are shown.

FIG. 13 shows an alternative downward perspective view of a children's pottery wheel of present embodiments without an attachment and additional features of the throwing arm pictured. Shown in this view is the housing, the throwing arm, the raised rear arch, the arch platform, the power and directional buttons, the first and second pivot points, the spinning plate, demarcations, and base fastener. Also shown is the centering pin receiving channel 1305 in the throwing arm, where the centering pines of the sculpting tools insert, and the receiving holes 1300 where the protrusion points of sculpting tools may attach. The centering pin receiving channel 1305 and receiving holes for the 1300 may allow for a firm and precise attachment of the sculpting tools onto the middle of the throwing arm, which is positioned above the center of the spinning plate. The receiving holes 1300 may be plastic engineering holes to reduce the thickness of the throwing arm, but may also double as detent features to receive hemispherical nubs of plastic to position sculpting tools.

Figure 15:
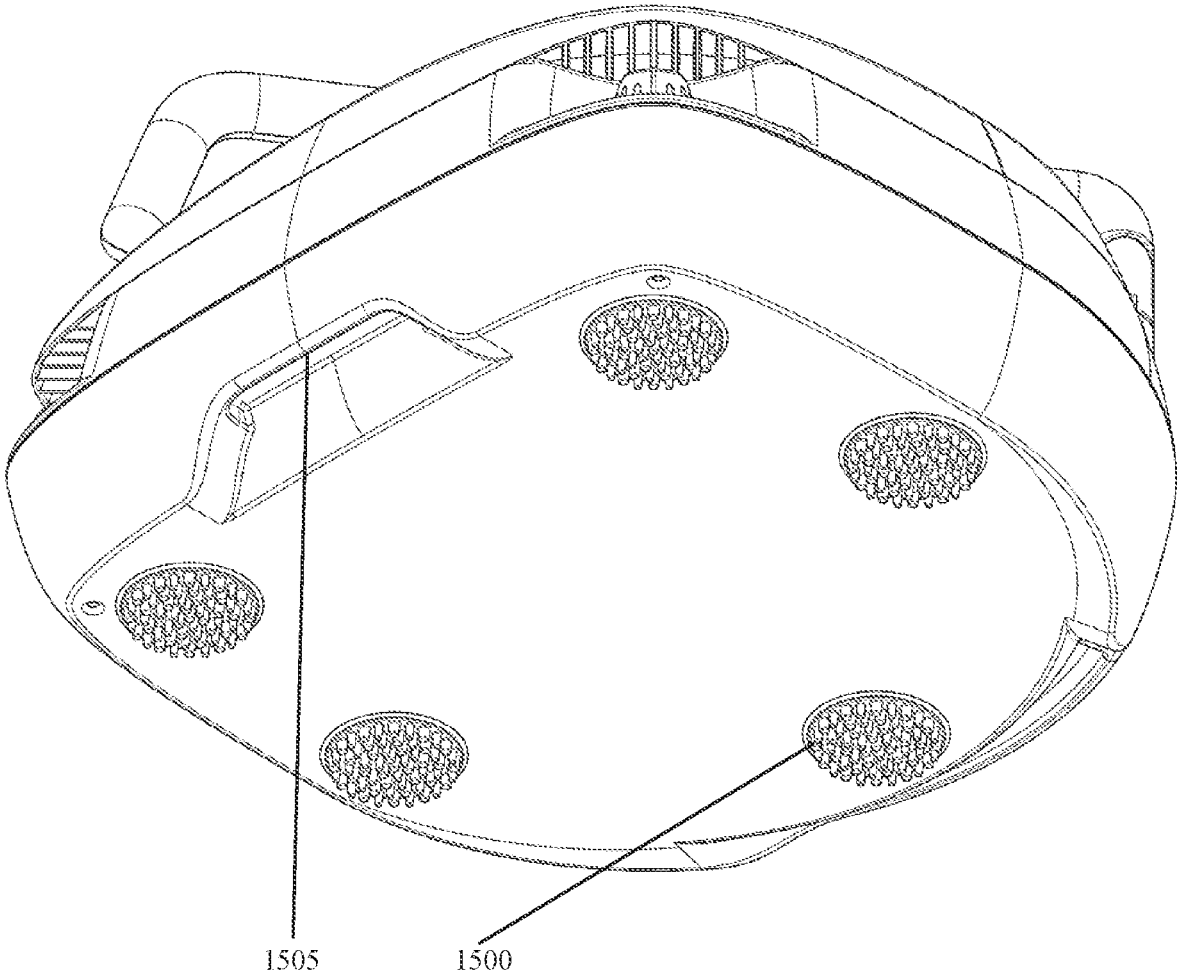
FIG. 15 shows an upward perspective view of a pottery wheel of present embodiments.

FIG. 15 shows an upward perspective view of a pottery wheel of present embodiments. Shown in this view is the housing, the front housing recess 1505 suitable for use as a grip, and a plurality of grips 1500 located on the bottom surface of the housing. The grips 1500 are textured with a pattern comprising a plurality of raised columns as to increase pressure on the surface of the column tips and provide increased traction between the pottery wheel and the surface it is placed upon. The patterned grips may serve as sound dampening feet with multiple star-fish feet that have varying geometry. Alternatively, suction cups may be used as the feet to improve grip on smooth surfaces. There may be a plurality of grips as is shown in FIG. 15, or there may be a single large grip which covers a larger area of the lower surface of the housing. The grips may be of any shape and need not be circular, and may comprise any patent on the grips to further enhance traction with the surface. The grips may be composed of rubber, an adhesive polymer, a surface with engineered roughness, or any other material which provides high traction with most surfaces.

Figure 16:
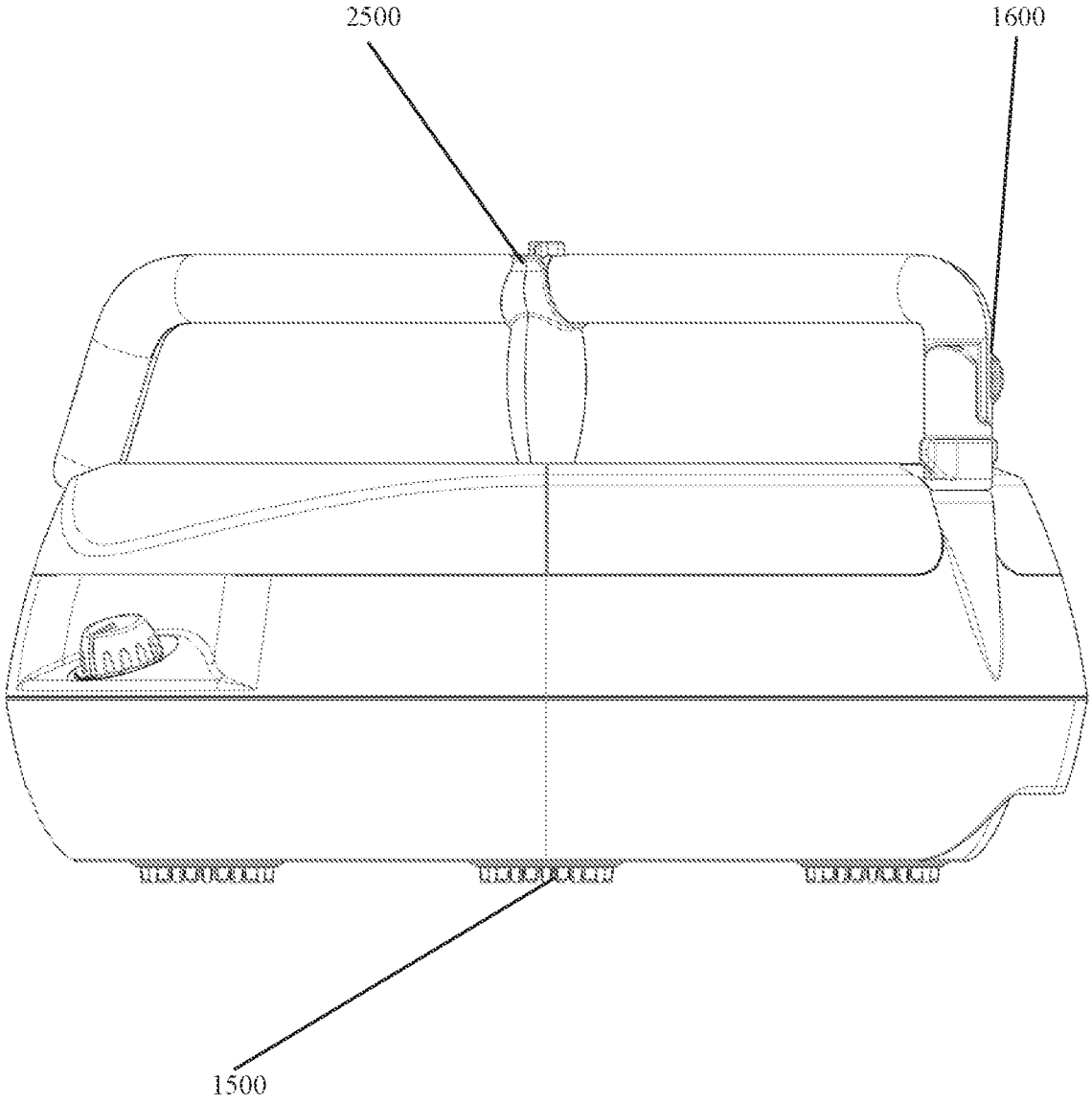
FIG. 16 shows a side view of a pottery wheel of present embodiments.

FIG. 16 shows a side view of a pottery wheel of present embodiments. Shown in this view is the housing, the throwing arm, the locking nut 1600, the first and second pivot points, the opening tool 2500, and the grips 1500.

Figure 17:
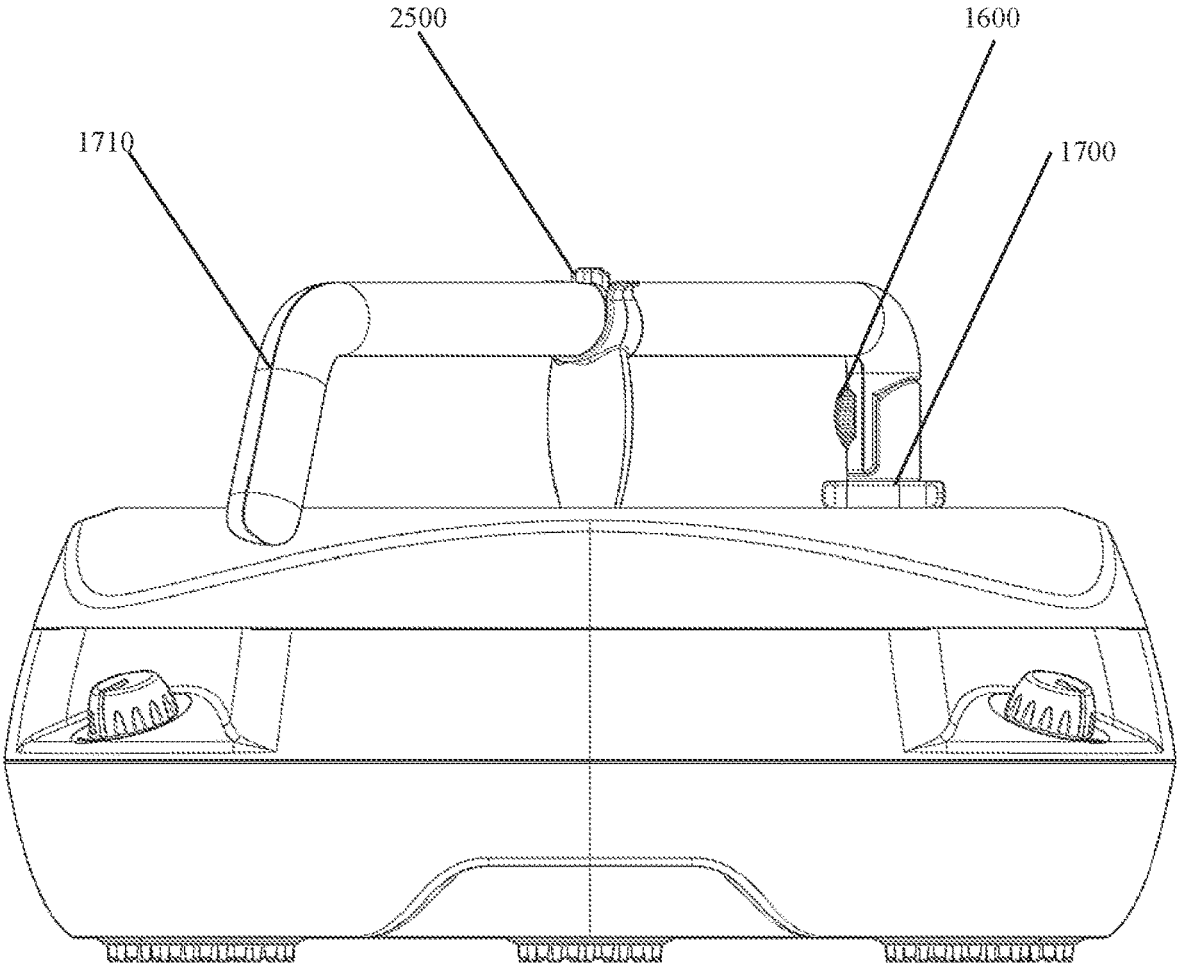
FIG. 17 shows a front view of a pottery wheel of present embodiments.

FIG. 17 shows a front view of a pottery wheel of present embodiments. Shown in this view is the housing, the throwing arm, the locking nut 1600, the first and second pivot points, and the opening tool 2500. Also shown is the base fastener 1700, the power and speed control dial, the direction control dial, the handle 1710 for the throwing arm, a recess in the front of the housing, and the grips. The grips may have a moderate vertical profile such that the lower face of the pottery wheel is slightly raised off the ground. The grips may be sound absorbing and reduce the vibration and sound transferred to the surface upon which the pottery wheel is placed.

Figure 18:
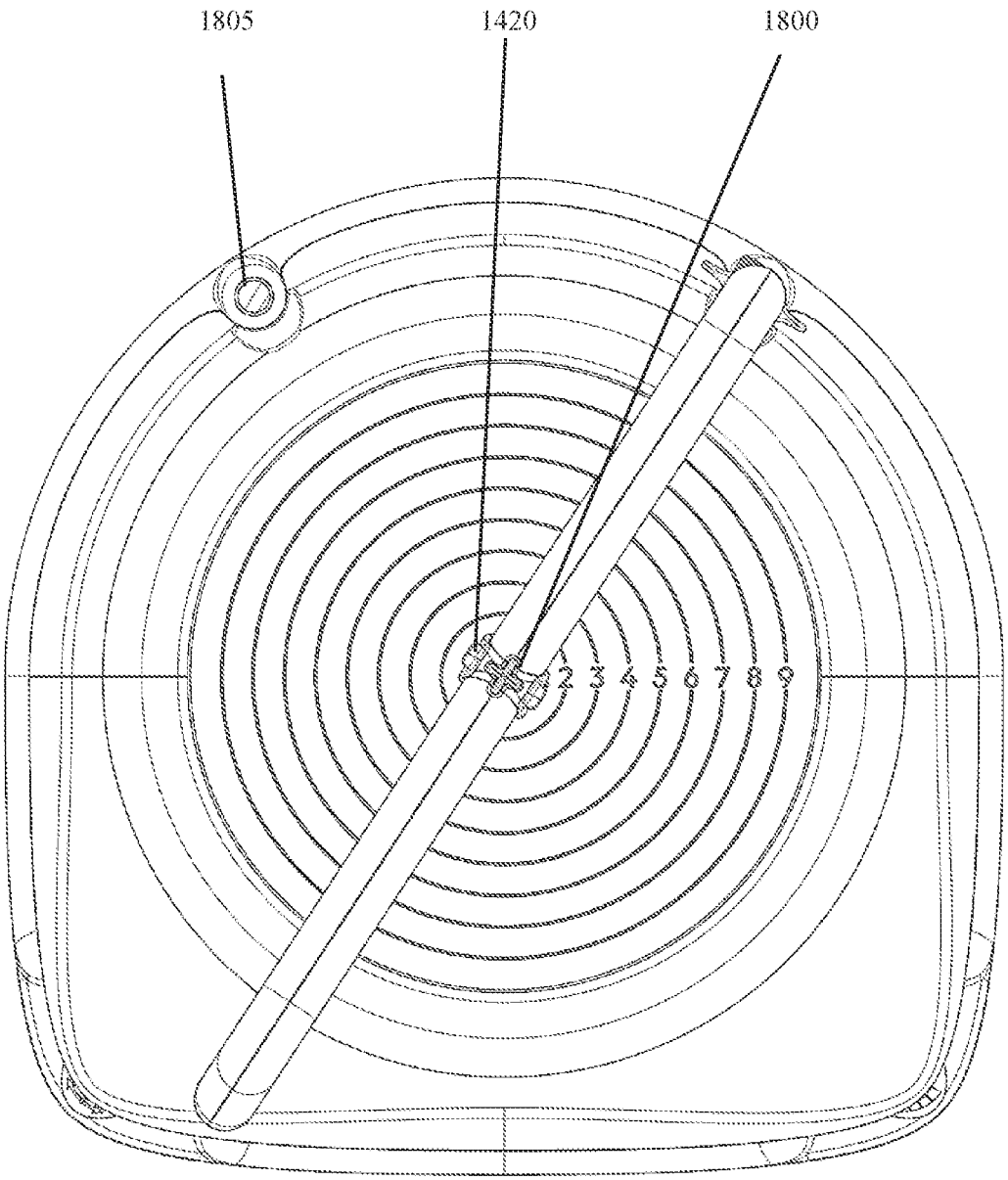
FIG. 18 shows a downward view of a pottery wheel of present embodiments.

FIG. 18 shows a downward view of a pottery wheel of present embodiments. Shown in this view is the housing, the throwing arm, a sculpting attachment 1420, the spinning plate, and the demarcations. Also shown is the centering pin 1800, and the left-handed attachment point 1805 for the throwing arm 1405.

Figure 19:
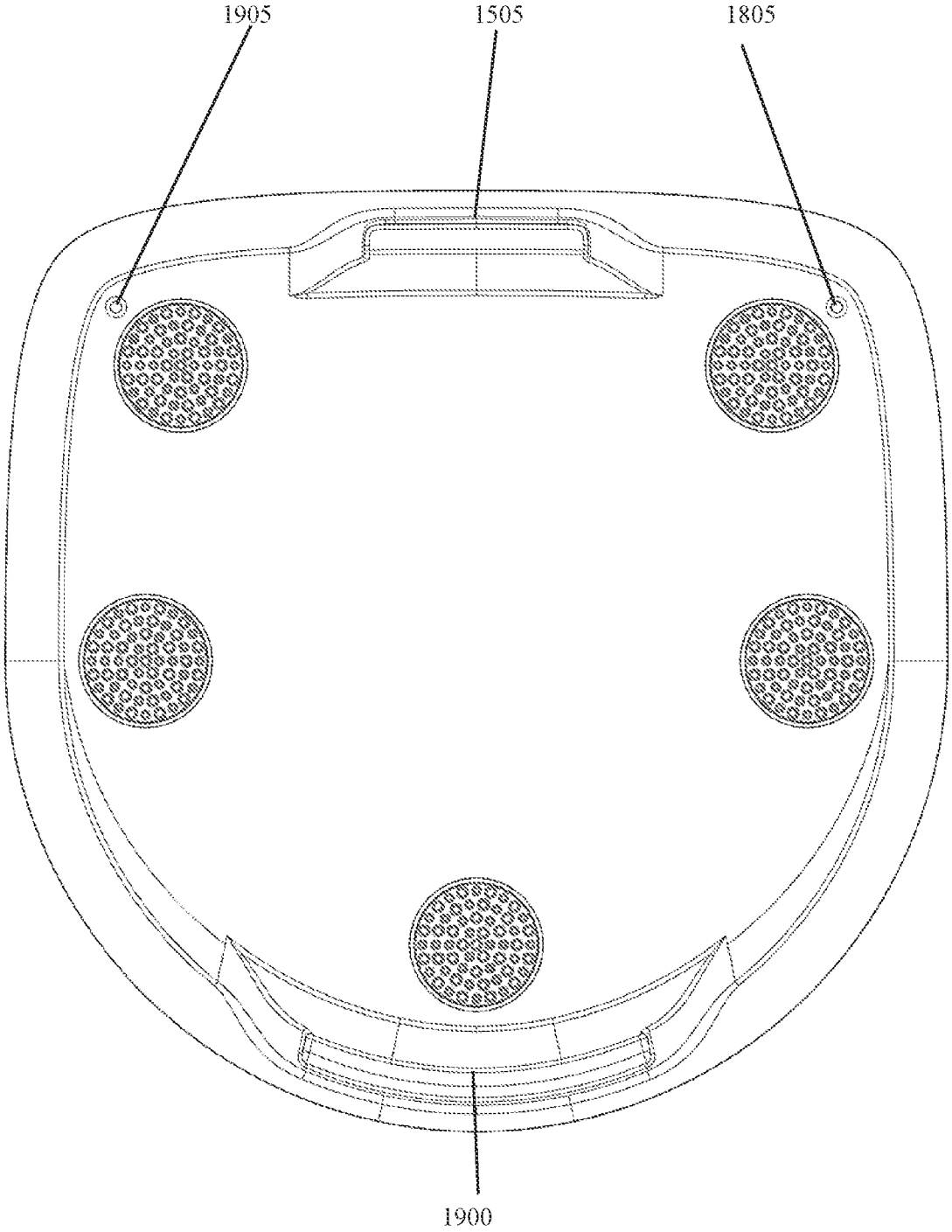
FIG. 19 shows an alternative upward view of a pottery wheel of present embodiments.

FIG. 19 shows an alternative upward view of a pottery wheel of present embodiments. Shown in this view is the housing, grips, the front housing recess 1505, the rear housing recess 1900, and the left and right-side throwing arm attachment points 1805/1905. In certain embodiments, the throwing arm may release by pressing a switch or button on the underside of the housing at the attachment points 1805/1905.

Figure 20:
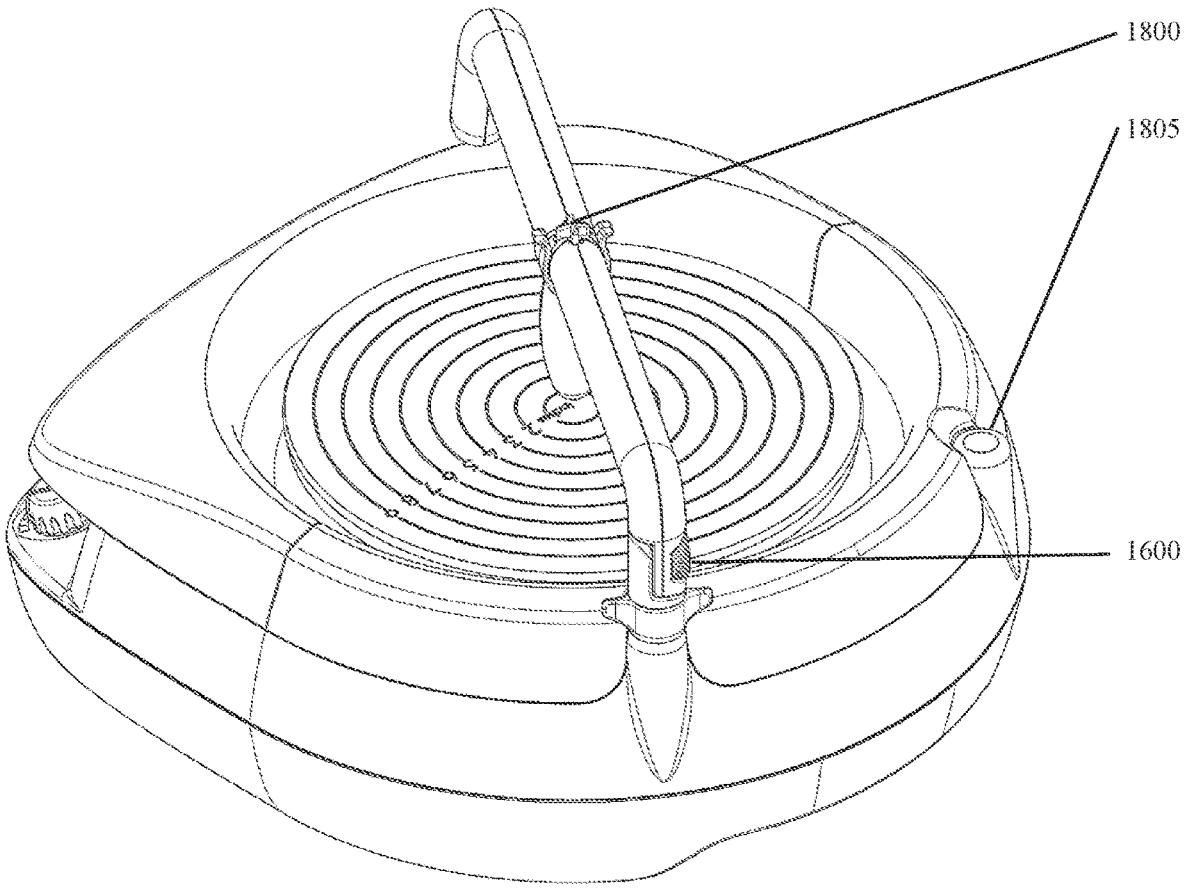
FIG. 20 shows an alternative perspective view of a pottery wheel of present embodiments.

FIG. 20 shows an alternative perspective view of a pottery wheel of present embodiments. Shown in this view is the housing, the throwing arm, the locking nut 1600, the first and second pivot points, the opening tool, spinning plate, demarcations, centering pin 1800, and left-handed attachment point 1805 for the throwing arm.

Figure 21:
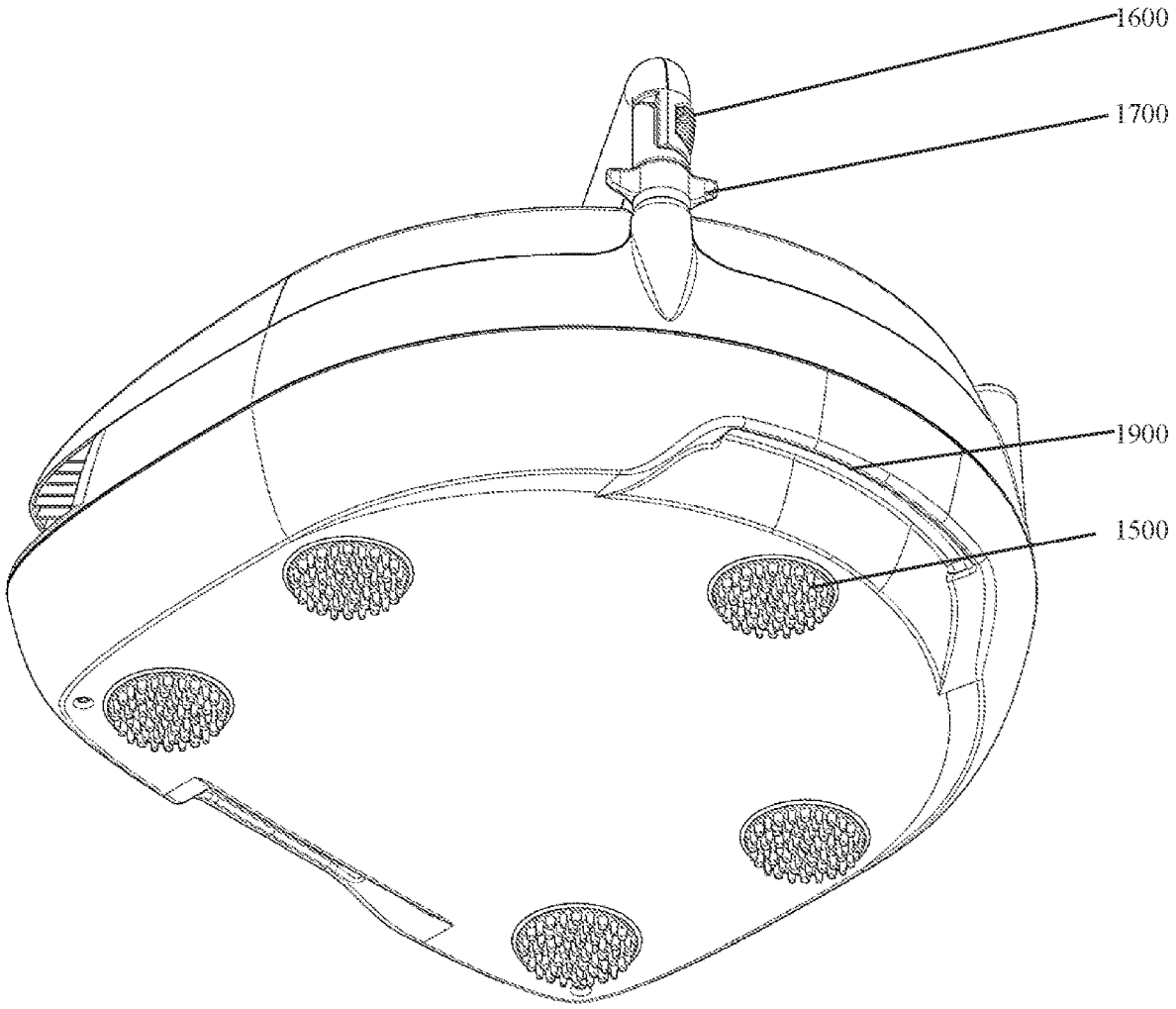
FIG. 21 shows an alternative upward perspective view of a pottery wheel of present embodiments.

FIG. 21 shows an alternative upward perspective view of a pottery wheel of present embodiments. Shown in this view is the housing, the throwing arm, the locking nut 1600, the first and second pivot points, the grips 1500, the base fastener 1700, the front housing recess, and the rear housing recess 1900.

Figure 22:
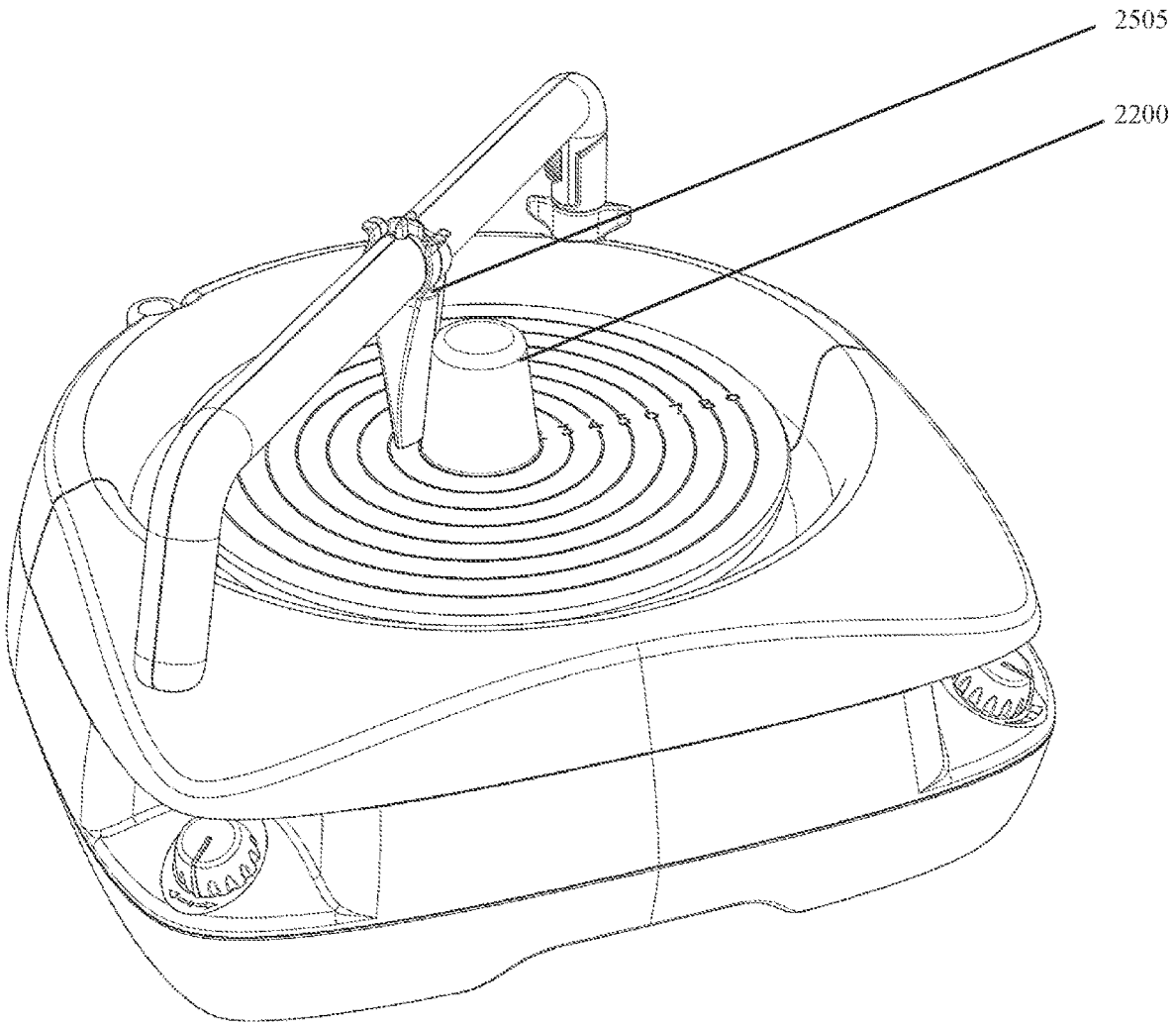
FIG. 22 shows a front perspective view of view of a pottery wheel of present embodiments with an attachment in use.

FIG. 22 shows a front perspective view of view of a pottery wheel of present embodiments with an attachment in use. Shown in this view is the housing, the throwing arm, the first and second pivot points, spinning plate, demarcations, the power and direction dials, handle, the centering pin, base fastener, and left-handed attachment point for the throwing arm. Also shown is a smooth ½ cone shaped vessel of clay 2200 being sculpted with the centering tool 2505 to produce a slanted linear edge on the clay, which curves smoothly around the circumference of the clay due to the rotation of the spinning plate.

Figure 23:
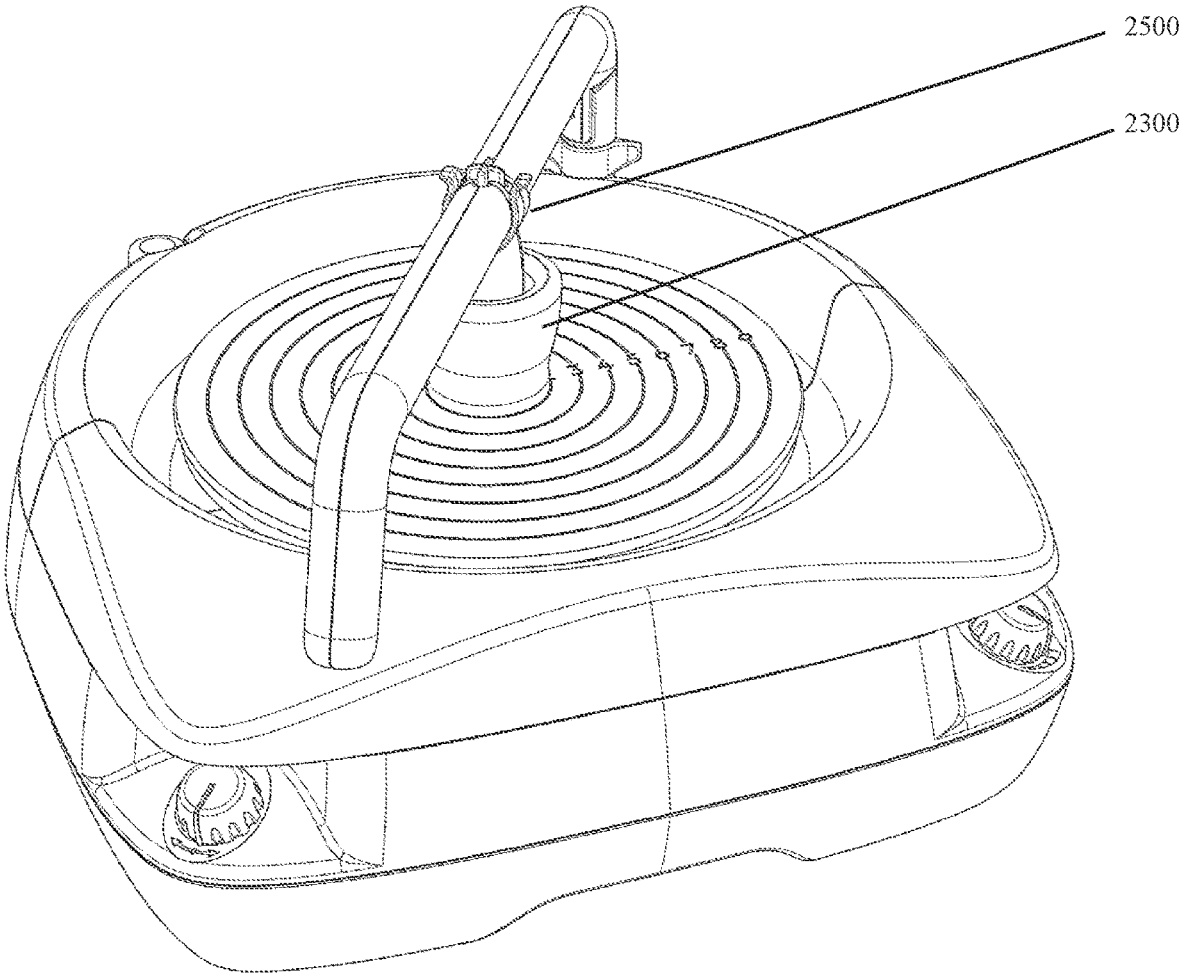
FIG. 23 shows a front perspective view of view of a pottery wheel of present embodiments with another attachment in use.

FIG. 23 shows a front perspective view of view of a pottery wheel of present embodiments with another attachment in use. Shown in this view is the housing, the throwing arm, the first and second pivot points, spinning plate, demarcations, the power and directional dials, the handle, base fastener, the centering pin, and left-handed attachment point for the throwing arm. Also shown is a pot shaped vessel of clay 2300 being sculpted by the opening tool 2500.

Figure 24:
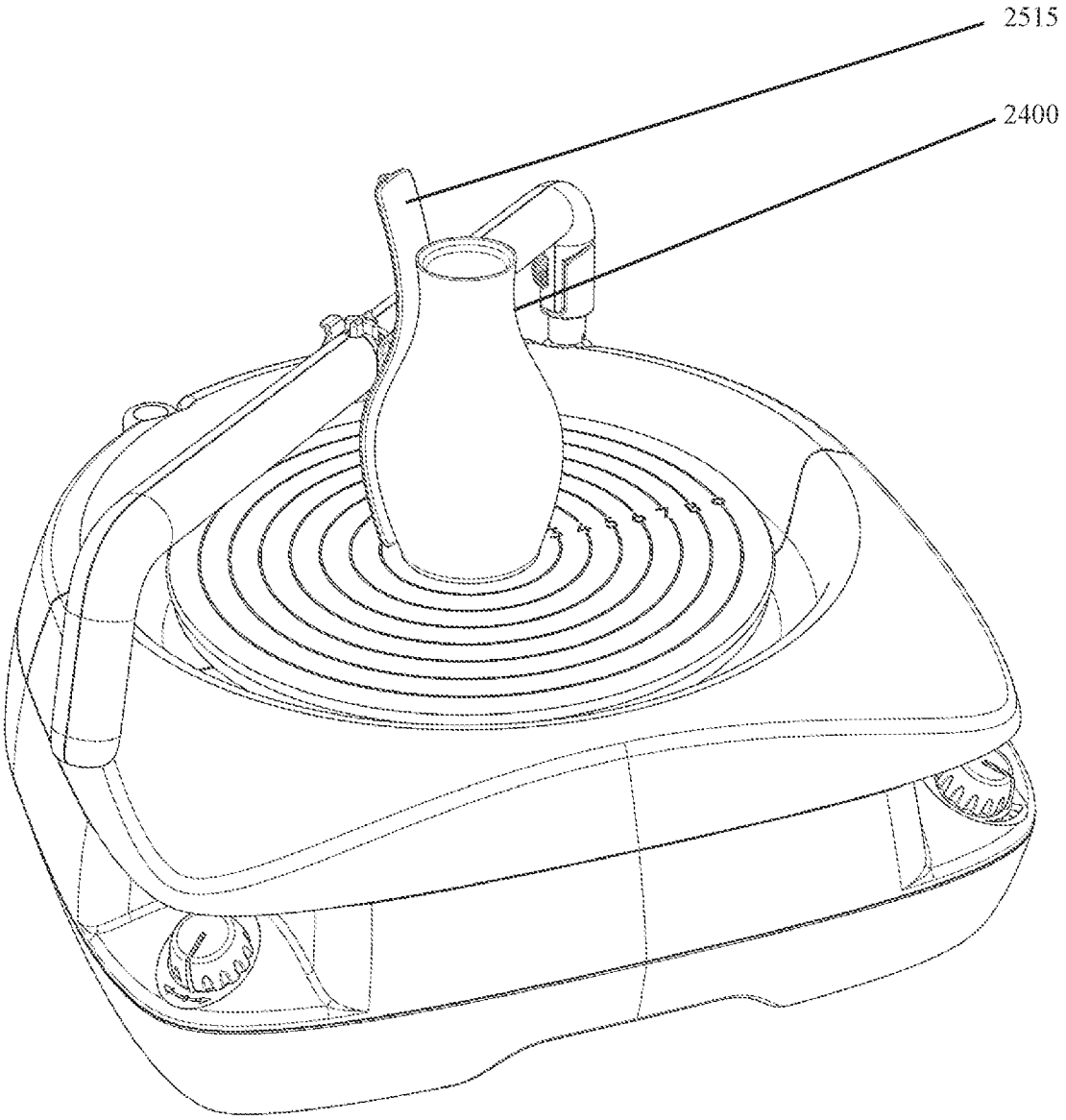
FIG. 24 shows a front perspective view of view of a pottery wheel of present embodiments with yet another attachment in use.

FIG. 24 shows a front perspective view of view of a pottery wheel of present embodiments with yet another attachment in use. Shown in this view is the housing, the throwing arm, the first and second pivot points, spinning plate, demarcations, the power and directional dials, the handle, base fastener, the centering pin, and left-handed attachment point for the throwing arm. Also shown is a vase shaped vessel of clay 2400 being sculpted by the vase forming tool 2515 in its vertical and upright position to produce a curved "S" shaped edge about the circumference of the clay, being widest at the bottom, narrowest in the center, before widening out slightly at the top. The same vase forming tool 2515 may be used in its vertical and upside-down position to produce a vessel of clay resembling a chalice, which is widest at the top and the bottom, and narrowest in the middle.

Figure 25:
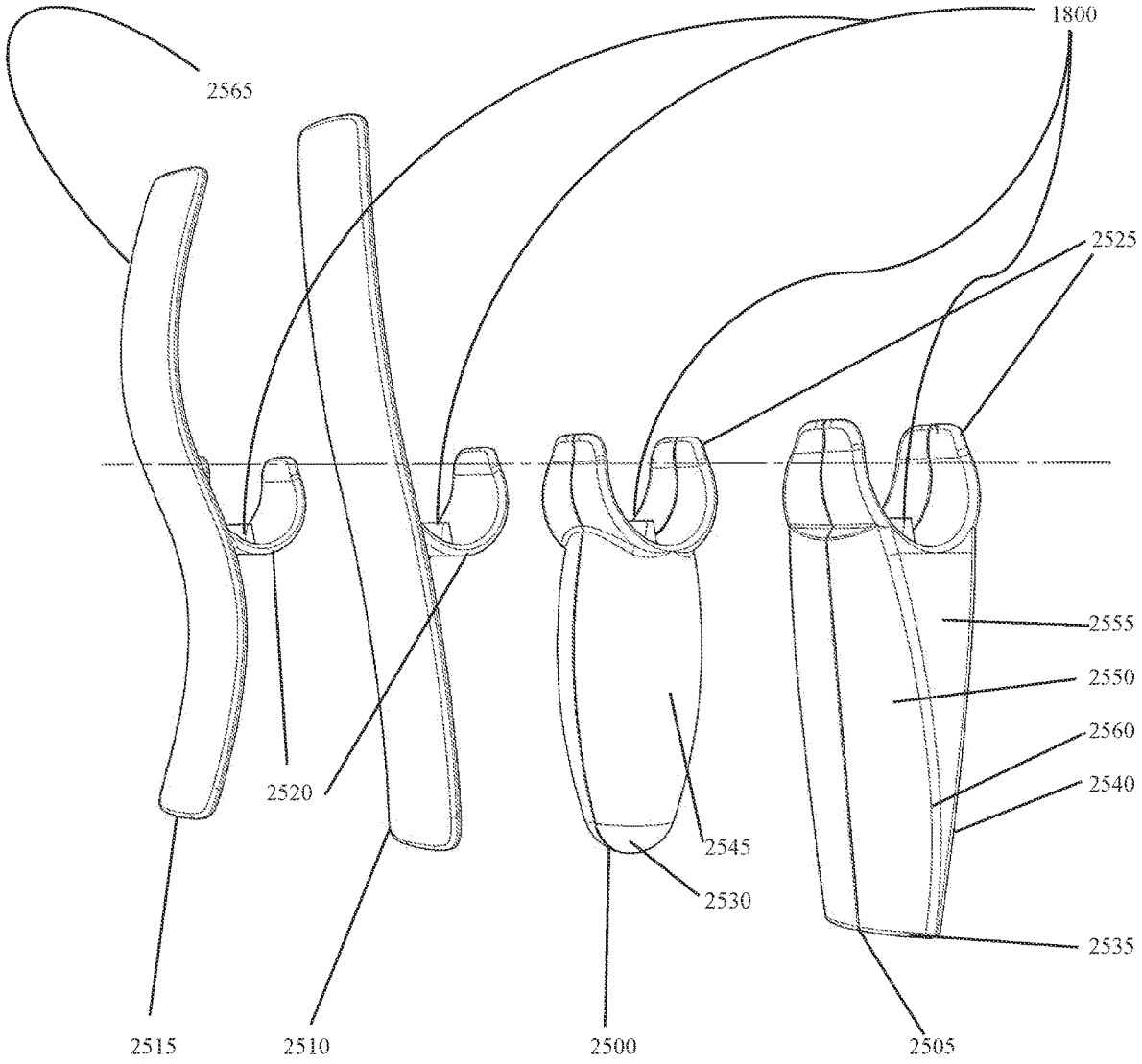
FIG. 25 shows some possible attachments suitable for use with the pottery wheel of present embodiments.

FIG. 25 shows some possible attachments suitable for use with the pottery wheel of present embodiments. Shown is the opening tool 2500, the centering tool 2505, the vase forming tool 2515, and the long edge shaping tool 2510. The vase forming tool 2515 and the long edge shaping tool 2510 can also be described as forming for shaping tools. Each of the sculpting attachments or tools comprises a half clip 2520 or a full clip 2525 to attach to the throwing arm, and a centering pin 1800 which inserts into a corresponding slot located at the middle of the throwing arm to quickly and easily facilitate the proper alignment and positioning of the attachment. Each of the sculpting tools may further comprise protrusion points located at the base of the half clip 2520 or full clip 2525 which attach to corresponding receiving holes in the throwing arm. Each of the tools may be flipped upside down, and rotated from vertical to horizontal such that they may attach to the throwing arm in four positions each: upright vertical; upright horizontal; downward vertical; and downward horizontal. The position of the vase forming tool 2515 and the long edge shaping tool 2510 can be concave, where it is flipped upside down with reverse curvature, or convex, where it is right side up. Further each of the tools is reversible, and may be attached in either a right hand or left hand orientation.

The opening tool 2500 may be useful for gently hollowing out the center of clay blocks to produce pots or vases. The opening tool 2500 comprises a rounded tip 2530 which will gently bore a hole in the clay starting at a small rounded point in the center of the block, and will gently displace the clay as the hole is formed. The opening tool 2500 has an ellipsoid or ovoid shaped body 2545 which has the largest diameter at the center of the body. The ovoid arc is concentric with the second pivot point such that the clay is displaced minimally. When boring out holes in blocks of clay, it is important to use a tool with a centered tip that places the force precisely at the center of the clay mass in order to avoid uneven distribution of clay about the axis of rotation, which will push more clay to one side of the mass, resulting in an asymmetric and aesthetically unappealing final product.

The opening tool 2500 represents an improvement over prior art sculpting tools in that it is configured to quickly and precisely attach to the middle of the throwing arm of present embodiments through the use of a centering pin 1800 which inserts into a corresponding receiving channel in the throwing arm. The cross shaped centering pin 1800 provides which closely inserts into the receiving channel provides stability to the tool while, the full clip 2525 is a retention mechanism which snaps around the circumference of the throwing arm, and quickly allows the tool to snap on and off. In combination, the centering pin 1800 and the full clip 2525 help hold the tool steady as it imparts force upon the clay. The ability to quickly and precisely center the tool upon the throwing arm and spinning wheel is a significant improvement over prior art sculpting tools which otherwise require great skill to place precisely in the middle of the clay. In this way, among others, the pottery wheels of present embodiments are suitable for children and individuals who lack the fine motor skills necessary to control sculpting tools.

The centering tool 2505 may be useful for producing a smooth edge about the circumference of a round of clay, centering a block of clay on the spinning plate, or removing protruding pieces of clay from the perimeter of the clay block, among other uses. The centering tool 2505 may comprise a flat bottom edge 2535, two generally flat faces 2550 orthogonal to the flat bottom edge, an additional two gently curved faces 2555 positioned adjacent and generally orthogonal to two generally flat faces, a straight edge 2540, and a slanted edge 2560 which connects the generally flat faces 2550 to the gently curved faces 2555.

The vase forming tool 2515 may be useful for producing vases with a smooth and irregular curved edge about the circumference of the clay, being widest at the bottom, narrowest in the center, before widening out slightly at the top. Its shape may resemble a vertical sine wave, or an "S" shape. It uses a half clip 2520 and centering pin 1800 to attach to the throwing arm, and contacts the clay about its perimeter.

The long edge shaping tool 2510 may be useful for producing vases or other sculptures with a flat linear edge along a particular plane, which smoothly curves around the circumference of the clay. It also may be useful for centering blocks of clay. Its shape may resemble a long, slanted rectangle. It uses a half clip 2520 and centering pin 1800 to attach to the throwing arm, and contacts the clay about its perimeter.

Each of the sculpting tools disclosed herein represents an improvement over prior art sculpting tools in that it is configured to quickly and precisely attach to the middle of the throwing arm of present embodiments through the use of a centering pin 1800 which inserts into a corresponding receiving channel in the throwing arm. The centering pin need not be cross shaped as is shown in the figures, but can be any shape which facilitate insertion and attachment into the throwing arm. However, a shape which can only be input as a particular angle, such as a cross, may be advantageous as it properly aligns the tool as it is inserted.

Figure 30A:
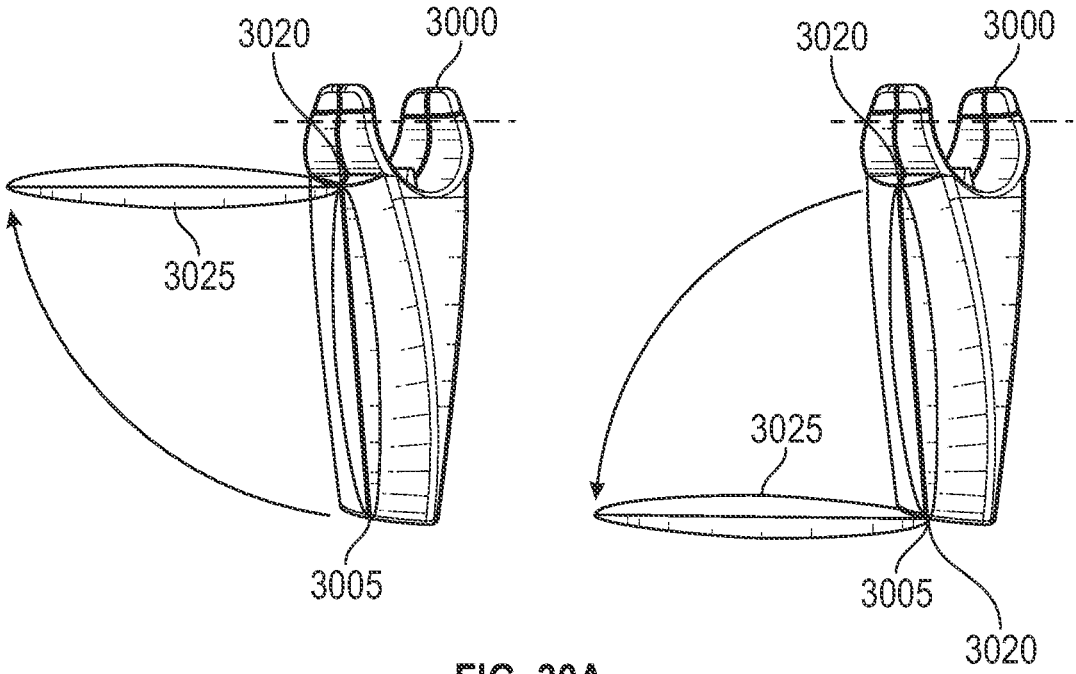
FIG. 30A shows an alternative embodiment of a sculpting tool for use with the pottery wheel of present embodiments.
Figure 30B:
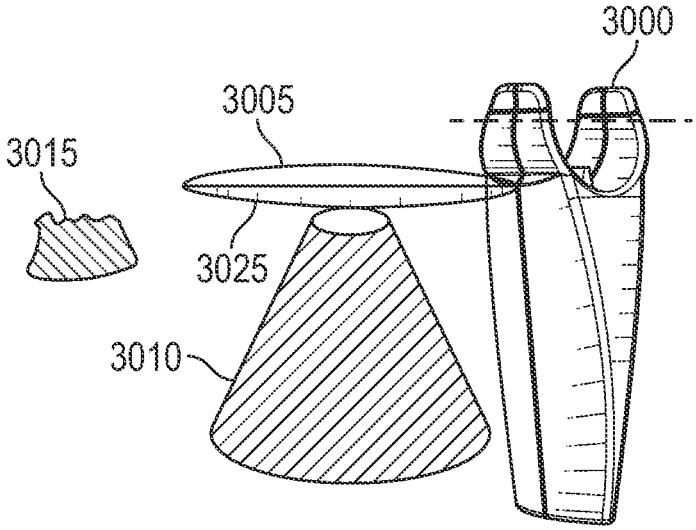
FIG. 30B shows an alternative embodiment of a sculpting tool in use with a vessel of clay.

FIGS. 30A and 30B show alternative embodiment of a sculpting tool configured to attach to the pottery wheels and throwing arms of present embodiments. A cutting tool 3000 which resembles the centering tool but which comprises a retractable blade 3025 positioned coextensive with the flat surface of the tool, having a sharp edge 3025 which flips down about a pivot point 3020 located at the top or the bottom of the cutting tool 3000, may be used. When in use the tool may slice the top part 3015 of a piece of clay 3010 as it rotates about the spinning plate and into the extended blade. In particular the wobbly top of a cone shaped round of clay may be sliced off to produce a smooth flat surface. The blade 3025 may flip outward from a side of the cutting tool 3000 and slice clay rotating on the wheel. For the children's pottery wheel, a flat but dull piece of plastic may be used to the same effect. The blade attachment may flip downward from the top of the attachment near where it connects to the throwing arm, pivoting about a point at the bottom of the tool; or it may flip upward from the bottom of the attachment, pivoting about a point at the top of the tool near where it connects to the throwing arm. Alternatively, the blade may be fixed in the open position and may not flip outward, and the user may rotate the tool from the left-side to the right-side orientation in order to use each side of the tool. Such a tool may present advantages over using wire, or other structure, to cut the clay which may result in the loss of clay. Further, the cutting tool 3000 may also work the clay into an even consistency as it is used.

In further alternative embodiments of sculpting tools configured to attach to the pottery wheels and throwing arms of present embodiments, there may be tools where: a centering tool resembles a flat plate; a centering tool resembles a curved plate; a centering tool is a rolling tool which can rotate about a bearing and spin on a vertical axis, possibly at the attachment point between the tool and the throwing arm; a sculpting tool resembles a cup shaped apparatus; and a sculpting tool that is configured to push the clay downward and inward at the same time.

Figure 26:
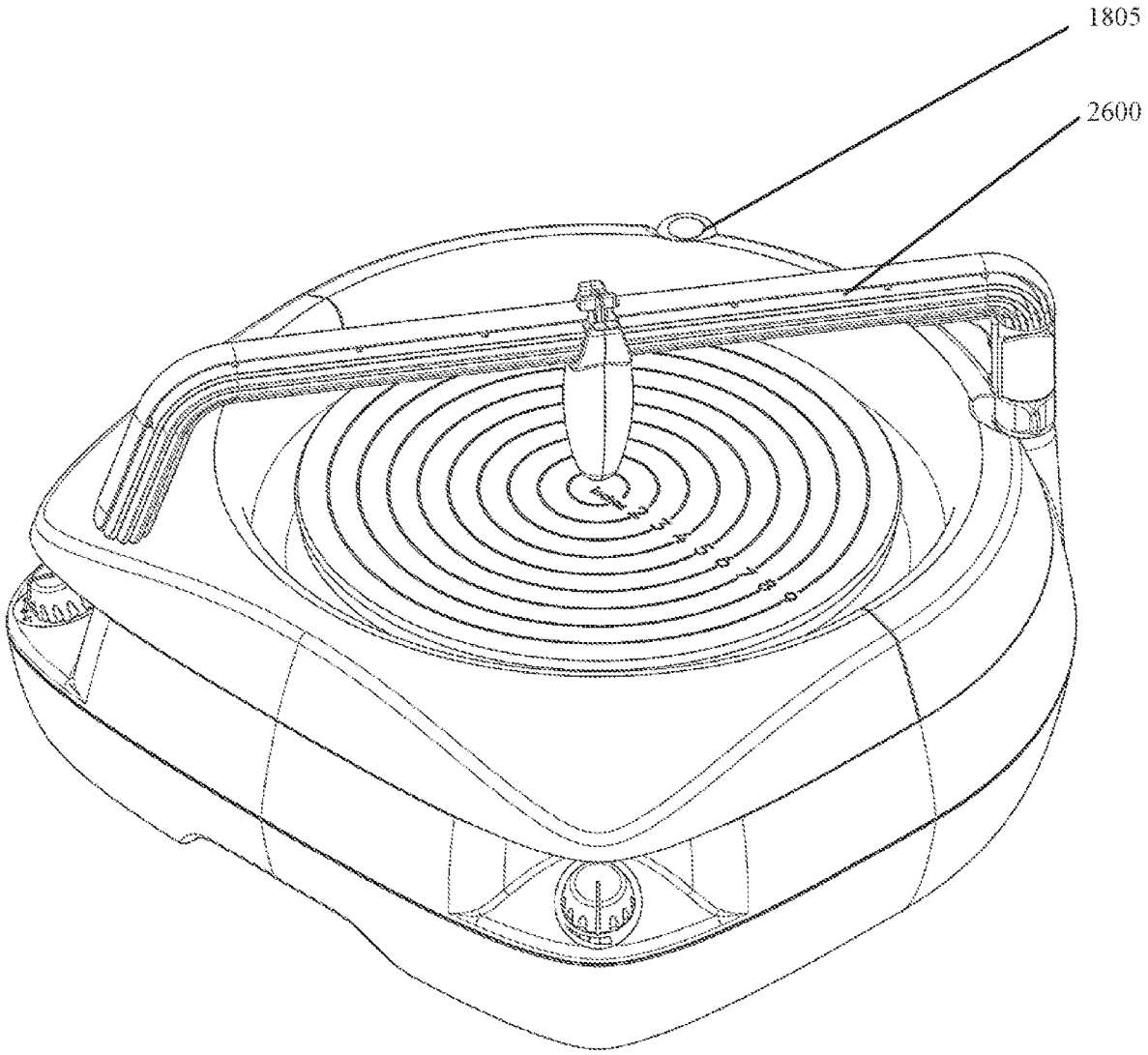
FIG. 26 shows an alternative downward perspective view of a pottery wheel of present embodiments with an attachment and additional features of the throwing arm are shown.

FIG. 26 shows an alternative downward perspective view of a pottery wheel of present embodiments with an attachment and additional features of the throwing arm. Shown in this view is the housing, the throwing arm, the first and second pivot points, spinning plate, demarcations, the power and directional dials, the handle, base fastener, the centering pin, and left-handed attachment point 1805 for the throwing arm. Also shown are a plurality of slots 2600 which are parallel to one another and run the length of the throwing arm. The slots may be suitable for attaching sculpting tools along the length of the arm at any point, as well as provide a surface with an enhanced grip for the user.

Figure 27:
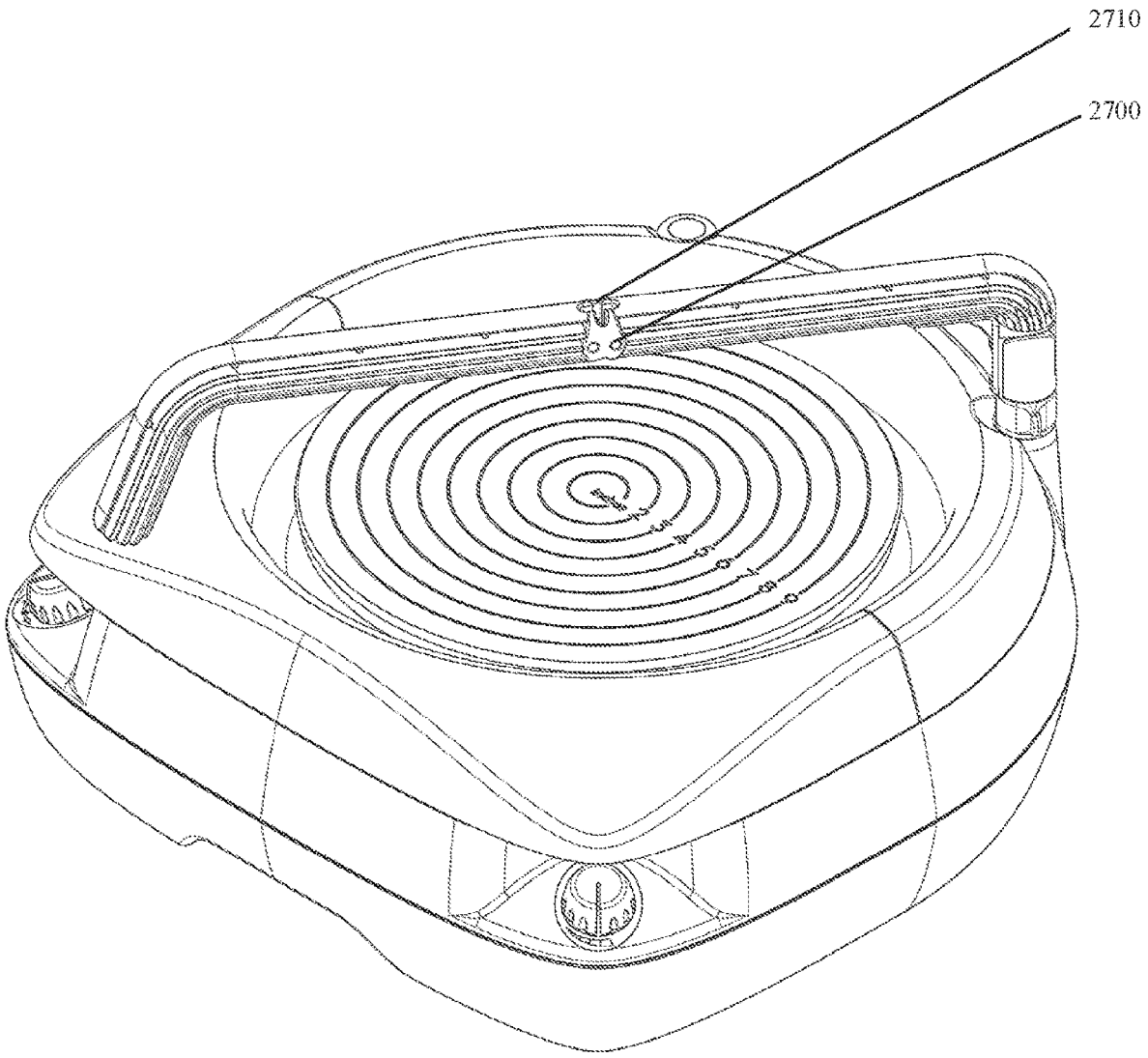
FIG. 27 shows an alternative downward perspective view of a pottery wheel of present embodiments without an attachment and additional features of the throwing arm are shown.

FIG. 27 shows an alternative downward perspective view of a pottery wheel of present embodiments without an attachment and additional features of the throwing arm. Shown in this view is the housing, the throwing arm, the first and second pivot points, spinning plate, demarcations, the power and directional dials, the handle, base fastener, and left-handed attachment point for the throwing arm. Also shown is the centering pin receiving channel 2710 in the throwing arm, where the centering pines of the sculpting tools insert, and the receiving holes 2700 where the protrusion points of the sculpting tools may attach. The centering pin receiving channel 2710 and receiving holes 2700 on the throwing arm may receive the protrusion points and centering pin of the sculpting tools, and allow for a fast, firm, and precise attachment of the sculpting tools exactly in the middle the throwing arm. The receiving holes 2700 may be plastic engineering holes to reduce the thickness of the throwing arm, but may also double as detent features to receive hemispherical nubs of plastic to position sculpting tools.

Figure 28:
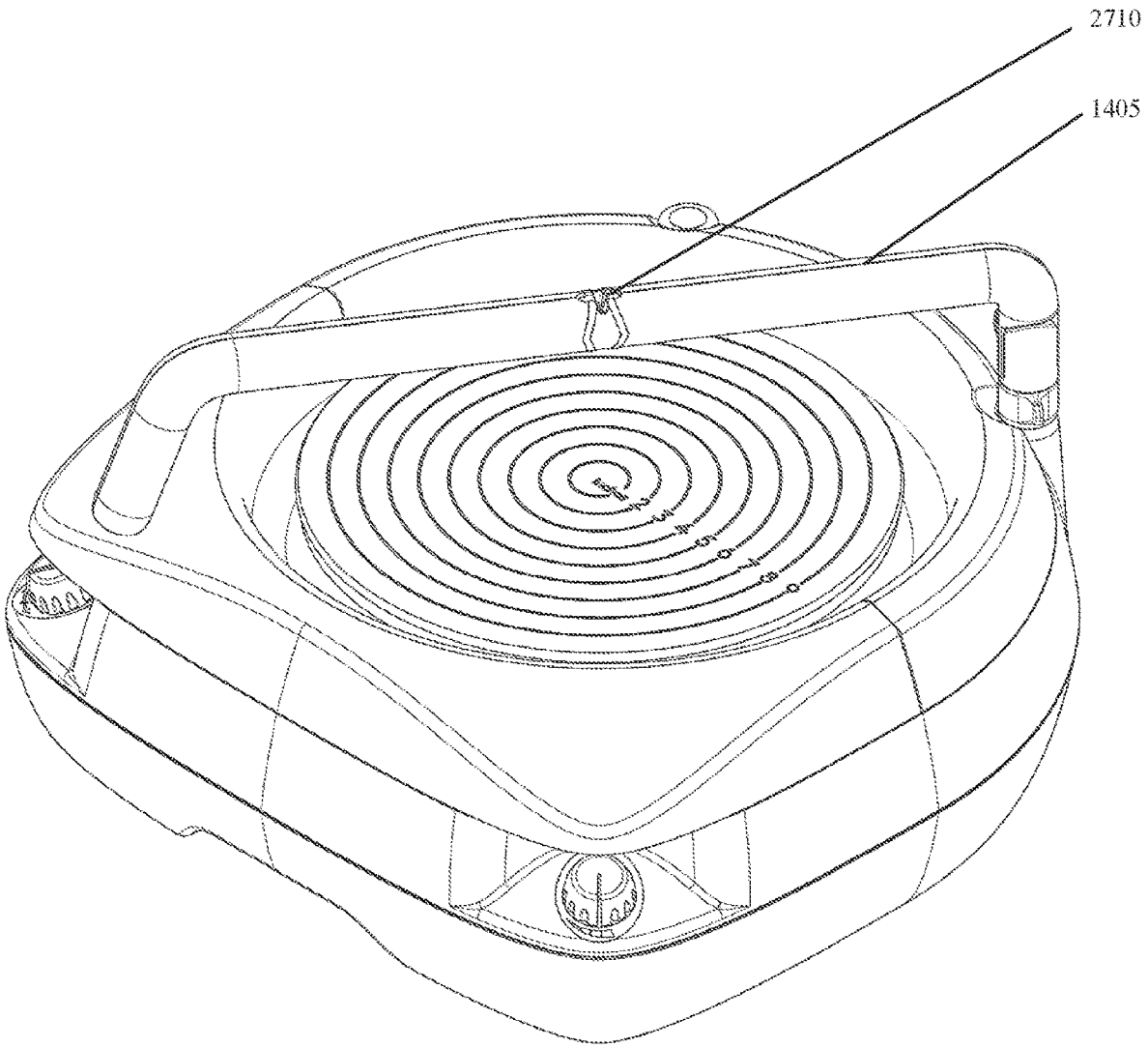
FIG. 28 shows an alternative downward perspective view of a pottery wheel of present embodiments without an attachment and with additional features of the throwing arm shown.

FIG. 28 shows an alternative downward perspective view of an alternative embodiment pottery wheel with additional features of the throwing arm. In this embodiment, the throwing arm has the centering pin receiving channel 2710 but lacks receiving holes and a plurality of parallel slots on the throwing arm 1405.

Figure 29A:
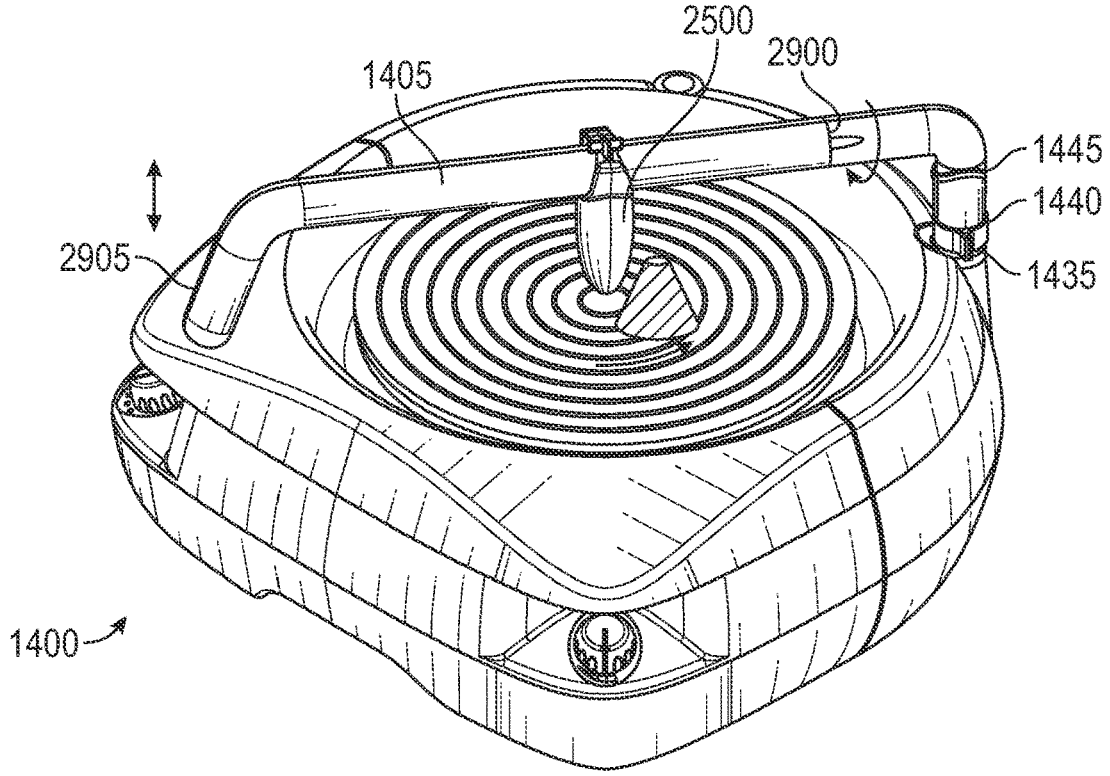
FIG. 29A shows an alternative embodiment of the throwing arm attachment of the pottery wheel in a neutral vertical position.
Figure 29B:
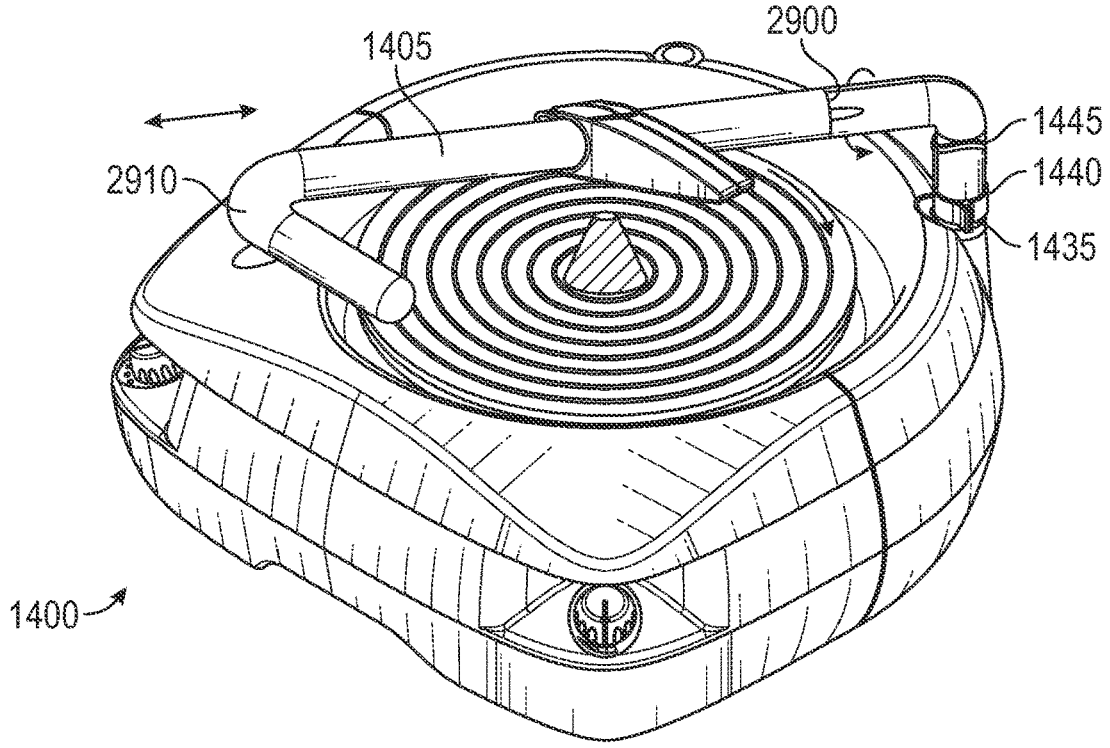
FIG. 29B shows an alternative embodiment of the throwing arm attachment of the pottery wheel rotated in a horizontal position.

FIGS. 29A and 29B show an alternative embodiment of the throwing arm 1405 where it further comprises a third pivot point 2900 located at the beginning of the horizontal segment of the throwing arm 1405 which allows the centering arm to be rotated from a neutral vertical position 2905 approximately 90 degrees to a horizontal position 2910 by the user twisting the throwing arm, possibly at the handle. This third pivot point may be spring loaded as to restore the throwing arm to a neutral position once the twisting force is removed. The third pivot point may also lock along the axis of rotation such that the throwing arm can be locked in a horizontally turned position, with a sculpting attachment pointing in a direction parallel to the face of the plate.

Figure 31A:
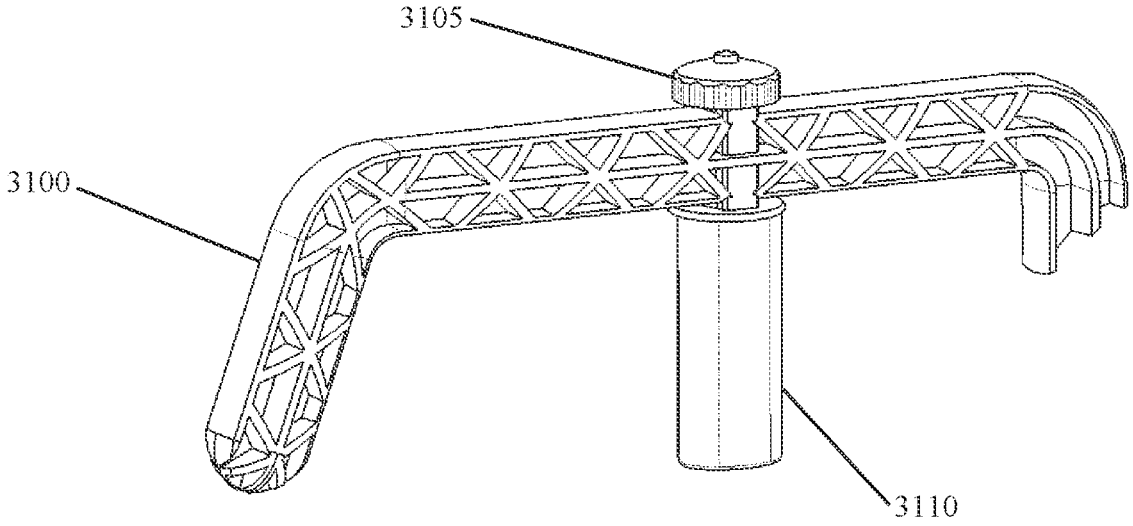
FIG. 31A shows an alternative embodiment of a throwing arm with a tool attached.
Figure 31B:
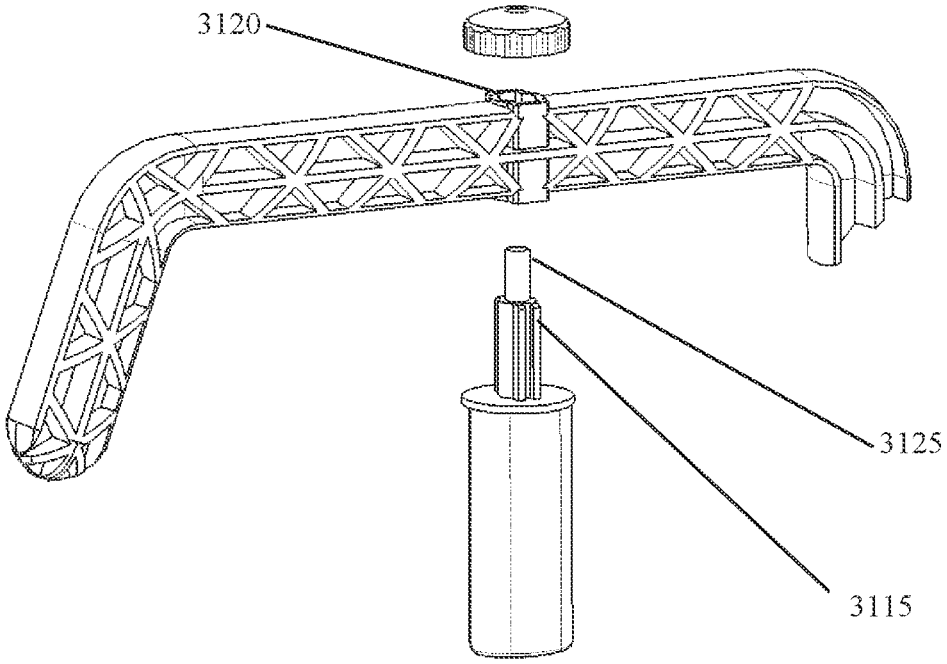
FIG. 31B shows an exploded view of an alternative embodiment of a throwing arm with the internal components of the tool and throwing arm visible.

FIGS. 31A and 31B show perspective views of an alternative embodiment of a throwing arm 3100. The alternative throwing arm may comprise an elongated centering pin channel 3120 and a securing cap 3105 which attach to an alternative centering tool 3110. The alternative centering tool 3110 may comprise an elongated centering pin 3115 and a securing top cylinder 3125. The elongated centering pin 3115 may allow for improved attachment to the alternative throwing arm relative to other embodiments of the throwing arm and centering pin. The securing top cylinder 3125 may be adapted to insert into a securing cap 3105 in order to anchor the alternative centering tool 3110 to the throwing arm. The securing top cylinder 3125 and securing cap 3105 may comprise threads such that the securing cap 3105 may screw onto the cylinder, and tighten the fit between the alternative centering tool 3110 and the throwing arm. Alternatively, it may attach using different means such as a snapping structure, a friction fit, or other fastening means known within the art.

Figure 32A:
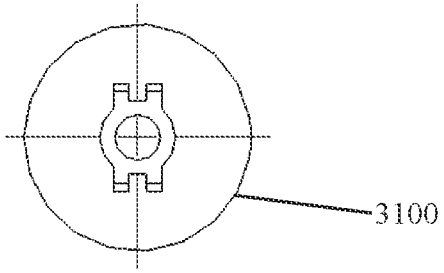
FIG. 32A shows a top down view of an alternative centering tool with an elongated centering pin.
Figure 32B:
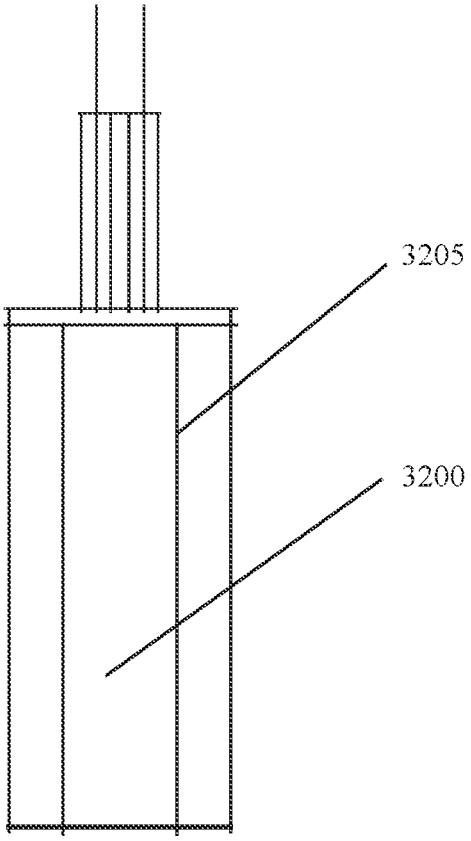
FIG. 32B shows a side view of an alternative centering tool with an elongated centering pin.
Figure 32C:
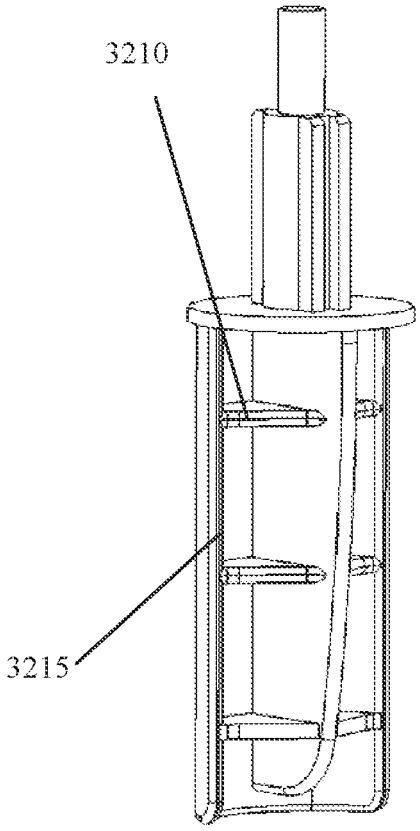
FIG. 32C shows a perspective view of an alternative centering tool with an elongated centering pin.

FIGS. 32A, 32B,and 32C show views of an alternative centering tool 3110 with an elongated centering pin 3115. The alternative centering tool 3110 may have a plurality of flat faces 3200 on one side of the tool, with an edge 3205 in between each face. It may be in the shape of a ½ prism, having complete coverings on only half of the tool, with the rear half of the tool being exposed. There may be a plurality of support members 3210 within the tool, and a flat edge 3215 which may be useful for cutting through rounds of clay rotating on the pottery wheel. Alternatively, the tool may be in the shape of a full prism and have coverings on both sides similar to the centering tool previously described.

Figure 33A:
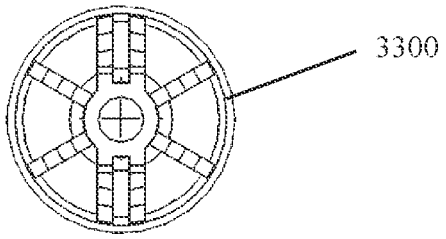
FIG. 33A shows a top down view of an opening tool with an elongated centering pin.
Figure 33B:
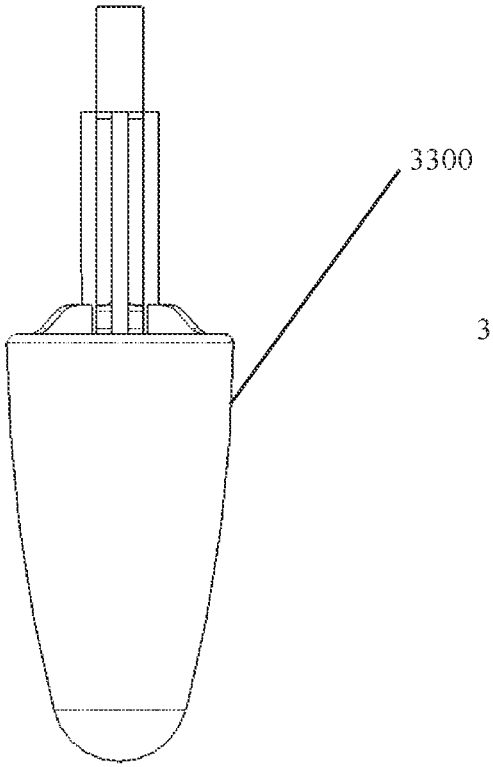
FIG. 33B shows a side view of an opening tool with an elongated centering pin.
Figure 33C:
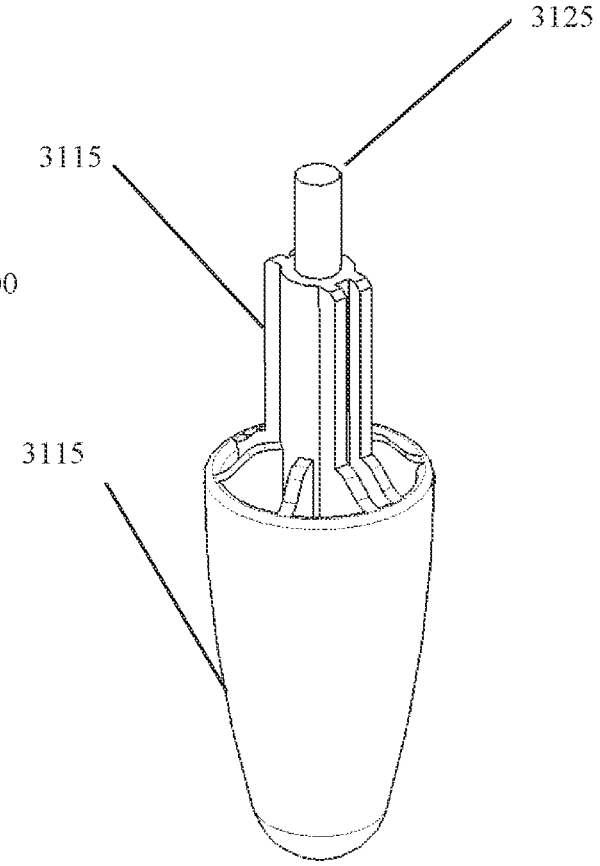
FIG. 33C shows a perspective view of an opening tool with an elongated centering pin.

FIGS. 33A, 33B,and 33C show views of an alternative opening tool 3300 with an elongated centering pin 3115. The alternative opening tool 3300 may also comprise a securing top cylinder 3125 at the tip of the elongated centering pin 3115 in order to attach a securing cap on top in order to secure it to the alternative throwing arm. It may have a rounded exterior surface 3115 as to sculpt a rounded shape into the center of vessels of clay. The alternative opening tool 3300 may be short enough such that it will not touch the spinning plate even when the throwing arm is fully extended in the downward position, as to prevent piercing through the bottom of a vessel of clay.

The pottery wheels of present embodiments, including the housing, throwing arm, fasteners, and spinning plate may be composed of a plastic, a polymer, aluminum, stainless steel, other metal, or any other suitable material. The pottery wheels of present embodiments may be composed of ABS or polypropylene. The throwing arm for the hobby pottery wheel embodiment in particular may be composed of aluminum or other metal, as well as its other components due to the increased power of the motor. The product may be manufactured by casting, molding, 3D printing, or any other method of manufacturing suitable for the chosen material.

One of ordinary skill in the art will recognize the inventive principles disclosed are not limited to the embodiments disclosed herein, and that various aspects of the disclosed embodiments can be combined to achieve additional embodiments. The applications of the present invention have been described largely by reference to specific examples and in terms of particular allocations of functionality to certain components. However, those of skill in the art will recognize that the invention can also be produced by components that distribute the functions of embodiments of this invention differently than herein described. Such variations and implementations are understood to be captured according to the following claims and within this disclosure.

What is claimed is:

1. A pottery wheel for engaging a workpiece, the pottery wheel comprising:

a housing;

a rotary motor within the housing;

a spinning plate attached on an upper surface of the housing powered by the rotary motor configured to spin in at least one direction;

at least one grip on a lower surface of the housing;

a throwing arm mounted to the upper surface of the housing outside the radius of the spinning plate, wherein the throwing arm is configured to pivot around a first point in two directions with at least one direction being towards the center of the spinning plate, wherein the throwing arm is configured to pivot around a second point in two directions with at least one direction being towards the center of the spinning plate, and wherein the throwing arm is configured to interchangeably attach to a plurality of tools, one at a time, at a common attachment point, wherein a first tool is a centering tool configured to mount on the throwing arm, and engage a side of a workpiece for centering the workpiece on the spinning plate; and wherein a second tool, interchangeable with the first tool, is a shaping tool configured to mount on the throwing arm and engage a top of the workpiece.

2. The pottery wheel of claim 1 further comprising at least one switch for adjusting the speed and direction of the spinning plate.

3. The pottery wheel of claim 1 wherein the throwing arm rotates about a third pivot point along the axis defined by the length of the throwing arm.

4. The pottery wheel of claim 3 wherein the throwing arm can lock into place about the third pivot point, and is spring loaded about the third pivot point.

5. The pottery wheel of claim 1 further comprising a second throwing arm mounted to the upper surface of the housing outside the radius of the spinning plate.

6. The pottery wheel of claim 5 further comprising demarcations on the spinning plate.

7. The pottery wheel of claim 1 wherein the throwing arm comprises at least one receiving channel positioned in the center of the throwing arm, which goes through the throwing arm.

8. The pottery wheel of claim 7 wherein the receiving channel positioned in the center of the throwing arm is configured to receive a centering pin which extends from a sculpting tool that is configured to attach to the throwing arm.

9. The pottery wheel of claim 8 wherein the at least one tool attaches to the throwing arm at a 90-degree angle relative to the length of the throwing arm.

10. The pottery wheel of claim 1 wherein the first pivot point is located below the second pivot point and allows the throwing arm to pivot across the face of the spinning plate in a plane parallel to the face of the spinning plate, and wherein the second pivot point allows the throwing arm to pivot towards and away from the face of the spinning plate.

11. The pottery wheel of claim 1 further comprising a torque limiter and an emergency shut off switch attached to the rotary motor.

12. A pottery wheel comprising:

a housing;

a rotary motor within the housing;

a spinning plate attached on an upper surface of the housing powered by the rotary motor configured to spin in at least one direction;

at least one grip on a lower surface of the housing;

a throwing arm mounted to the upper surface of the housing outside the radius of the spinning plate, wherein the throwing arm is configured to pivot around a first point in two directions with at least one direction being towards the center of the spinning plate, wherein the throwing arm is configured to pivot around a second point in two directions with at least one direction being towards the center of the spinning plate, wherein the throwing arm is configured to attach to a plurality of tools, wherein a first tool comprises a centering tool and a second tool comprises a shaping tool, and wherein the throwing arm further comprises at least one slot for interchangeable attachment of the tools at the center of the throwing arm, and wherein the tools attach to the throwing arm at a 90-degree angle relative to the throwing arm.

13. The pottery wheel of claim 12 wherein the spinning plate is removable from the housing.

14. The pottery wheel of claim 12 further comprising at least one switch for adjusting the speed and direction of the motor.

15. The pottery wheel of claim 12 wherein the length of the throwing arm rotates about a third pivot point, wherein the throwing arm can lock into place about the third pivot point, and is spring loaded about the third pivot point.

16. The pottery wheel of claim 12 wherein the first pivot point is located below the second pivot point and allows the throwing arm to pivot across the face of the spinning plate in a plane parallel to the face of the spinning plate, and wherein the second pivot point allows the throwing arm to pivot towards and away from the face of the spinning plate.

17. The pottery wheel of claim 12 further comprising a second throwing arm mounted to the upper surface of the housing outside the radius of the spinning plate.

18. The pottery wheel of claim 12 further comprising a catch tray positioned below the spinning plate, and wherein the spinning plate is removable from the housing by splitting into two pieces.

19. A pottery wheel comprising:

a housing;

an electrically powered rotary motor within the housing;

a spinning plate removably attached on an upper surface of the housing powered by the rotary motor configured to spin clockwise and counterclockwise;

a plurality of grips on a bottom surface of the housing which faces the ground;

a first switch for controlling the direction of the spinning plate;

a second switch for adjustably controlling the speed of the spinning plate;

a plurality of demarcations on the spinning plate;

a catch tray positioned below the spinning plate;

a throwing arm removably mounted to the upper surface of the housing outside the radius of the spinning plate, wherein the throwing arm is configured to pivot around a first point in two directions with at least one direction being towards the center of the spinning plate, wherein the throwing arm is configured to pivot around a second point in two directions with at least one direction being towards the center of the spinning plate, wherein the throwing arm is configured to interchangeably attach at a common attachment point to a plurality of tools at a 90-degree angle relative to the throwing arm, wherein a first tool comprises a centering tool, wherein a second tool comprises a shaping tool, wherein the spinning plate is removable by splitting into two pieces, wherein the first pivot point is located below the second pivot point and allows the throwing arm to pivot across the face of the spinning plate in a plane parallel to the face of the spinning plate, and wherein the second pivot point allows the throwing arm to pivot towards and away from the face of the spinning plate in a direction generally perpendicular to the face of the spinning plate.

* * * * *